US006062565A

United States Patent [19]

Chadband et al.

[11] Patent Number: 6,062,565

[45] **Date of Patent: *May 16, 2000**

[54] METHOD OF BET PLACEMENT AND WAGER DISTRIBUTION IN DOUBLE-HAND GAMES

[76] Inventors: Paul G. Chadband, 1521 Montellano, San Jose, Calif. 95120; Hai Q. Huynh, 663 High Glen Dr., San Jose, Calif. 95113; James R. McKee, 969A Franquette Ave., San Jose, Calif. 95125

[ * ] Notice: This patent is subject to a terminal disclaimer.

[21] Appl. No.: 09/075,634

[22] Filed: May 11, 1998

Related U.S. Application Data

[63] Continuation-in-part of application No. 08/845,962, Apr. 30, 1997, Pat. No. 5,871,213.

[51] Int. Cl.[7] ..... A63F 1/00

[52] U.S. Cl. ..... 273/292

[58] Field of Search ..... 273/292; 463/12, 463/13

[56] References Cited

U.S. PATENT DOCUMENTS 5,314,194 5/1994 Wolf ..... 273/292
5,397,128 3/1995 Potter ..... 273/292
5,452,899 9/1995 Skratulia et al. ..... 273/292
5,452,900 9/1995 Skratulia et al. ..... 273/292

OTHER PUBLICATIONS

"Pai Gow Poker", WIN magazine, Linya Quan, Apr. 1992, pp. 39, 40 and 70.

*Primary Examiner*—Benjamin H. Layno
*Attorney, Agent, or Firm*—Finley & Berg, L.L.P.

[57] ABSTRACT

A method of bet placement and wager distribution for use with double-hand gambling games; each round frontline players place wagers on their front hand final ranking into a frontline front hand pot and wagers on their back hand final ranking into a frontline back hand pot, and backline players place wagers on either the final ranking of a frontline player's front hand into a backline front hand pot or the final ranking of a frontline player's back hand into a backline back hand pot. A full game round is played, and then the relative rankings of the front and back hands are determined, identifying both highest ranked and second highest ranked hands among the frontline front hands, the frontline back hands, the backline front hands, and the backline back hands. The four pots are then apportioned between the controllers of the highest-ranked and second-highest hands corresponding to each pot, each apportionment according to a respective predetermined formula.

24 Claims, 15 Drawing Sheets

METHOD OF BET PLACEMENT AND WAGER DISTRIBUTION IN DOUBLE-HAND GAMES

CROSS-REFERENCES TO RELATED APPLICATIONS

This is a continuation-in-part of Application Ser. No. 08/845,962, filed Apr. 30, 1997 now U.S. Pat. No. 5,871,213 and entitled "Method of Bet Placement and Wager Distribution."

FIELD OF THE INVENTION

This invention relates to methods of bet placement and distributions of wagers for double-hand multi-player gambling games.

BACKGROUND OF THE INVENTION

The primary difference between a standard game and a gambling game is the wager, and wagering methods largely define the appeal of a gambling game. Many of the most common casino games have been popular for centuries, and for the most part, the wagering methods used to gamble on the results of the games are equally as hallowed. By offering a new method of wagering, the excitement of existing games may be enhanced, and players will be further attracted to play.

Traditional gambling, especially as seen in casinos, is conducted in two main modes. The first, most common mode involves players betting against the house. This includes games such as blackjack or roulette. The rules and setup of these games are designed such that the odds favor the house over the players, and from this odds discrepancy the house makes its profit. Such games deny the player the opportunity to test the player's luck in an even odds situation.

Additionally, the wager distribution in these games does not allow the player to win more than the amount the player bet on a given bet except where the odds are prohibitive against the player winning. In blackjack, where players have close to equal odds of winning, players only have the opportunity to win as much as the amount of their bet, except on rare blackjack hands. In other games, such as roulette, it is possible for the player to win many times the amount of the bet, but only if the player defeats odds such as thirty-eight to one. None of these games allow players having equal odds of winning to win more than the amount of their bet.

The second, less common casino gambling mode involves players competing against each other. An example of such a game is poker. However, unlike games against the house, which allow multiple players to win, these games are usually formulated such that the winner takes all. This offers less excitement than a game in which multiple players win on each bet.

Additionally, in games where players compete directly against each other, usually one player must serve as a banker or a player/banker. Where a player is solely the banker, that player cannot enjoy playing the game on that round. Where a player serves as a player/banker, disputes over money handling are more likely to occur as the banker has a direct stake in who wins or loses. Use of a banker or player/banker also complicates the game, as some means becomes necessary to identify which player serves the role each round.

Finally, few games in either mode provide the opportunity for a second level of wagering in which second line wagerers may wager between themselves on the relative success of the active players. No background art has been found which uses such second level wagering in combination with a method of wager distribution which allows multiple second line wagerers to win on each bet.

None of the foregoing games use wager distribution methods in which multiple players win each round, all players may play every round, all players compete against each other at even odds while still having the opportunity to win an amount greater than which they bet, and second line wagering is permitted. Furthermore, none of the foregoing games apply such a wagering method to double-hand games such as Pai Gow, Pai Gow Poker, and Double Hand Poker.

In Double Hand Poker, each player receives seven cards, from which that player forms two hands: a front, two-card hand and a back, five-card hand. In play, each player's front hand is compared against the other front hands, and each player's back hand is compared against the other back hands. Double Hand Poker is usually played with one pot, and to win the pot, one player must win (have the highest ranked hand) both the front hand and the back hand. This method of playing Double Hand Poker results in many "pushes" in which one player wins the front hand and another player wins the back hand.

No background art has been identified wherein Double Hand Poker is played with separate front hand and back hand pots with the winner of the front hand taking the front hand pot and the winner of the back hand taking the back hand pot.

SUMMARY OF THE INVENTION

The present invention, "Players' Action Pot," is a novel bet placement and wager distribution method for use in conjunction with a double-hand gambling game. This method may be applied to many popular existing casino games, including tile games such as Pai Gow or card games such as Pai Gow Poker or Double Hand Poker. The game is conducted in rounds of play, with a plurality of players, and each player controls a front hand and a back hand, each of which can be ranked in comparison to the other players' front hands and back hands, respectively.

At the beginning of each round of play of the associated game, "frontline" players place a frontline front wager on the final ranking of their front hands into a frontline front hand wagering area, and a frontline back wager on the final ranking of their back hands into a frontline back hand wagering area. Backline players choose at least one frontline player's hand on which to wager, whether it be a front hand or a back hand, and wager on that hand by placing a backline front or back wager into the appropriate backline front hand wagering area or backline back hand wagering area corresponding to the front or back hand upon which that backline player choose to wager. The game round is then fully played out according to the rules of the game.

The relative rankings of the frontline players' front hands are then determined, identifying a highest ranked frontline front hand or hands and a second highest ranked front hand or hands. Next, the relative rankings of the frontline players' back hand or hands are determined, identifying a highest ranked frontline back hand or hands and a second highest ranked frontline back hand or hands. The relative rankings of the backline players are then determined in relation first to the front hands on which they bet and then to the back hands on which they bet. By reference to the rankings of the frontline front hands selected by the backline players, a highest ranked backline front hand or hands and a second-highest ranked backline front hand or hands are identified. By reference to the frontline back hands selected by the backline players, a highest ranked backline back hand or hands and a second highest ranked backline back hand or hands are identified.

Four "pots" are collected: a frontline front hand pot, composed of all wagers placed into the frontline front hand wagering areas; a frontline back hand pot, composed of all wagers placed into the frontline back hand wagering areas; a backline front hand pot, composed of all wagers placed into the backline front hand wagering areas; and a backline back hand pot, composed of all wagers placed into the backline back hand wagering areas.

The frontline front hand pot is then apportioned between the frontline players controlling the highest-ranked and second-highest ranked frontline front hands according to a predetermined formula, and the frontline back hand pot is apportioned between the frontline players controlling the highest ranked and second-highest ranked frontline back hands according to a predetermined formula. Next, the backline front hand pot is apportioned between the backline players controlling the highest-ranked and second-highest ranked backline front hands according to a predetermined formula, and the backline back hand pot is apportioned between the backline players controlling the highest-ranked and second-highest ranked backline back hands according to a predetermined formula.

An object of the present invention is to provide a wagering method which avoids the "winner takes all" betting scheme by splitting the frontline front hand, frontline back hand, backline front hand, and backline back hand pots to pay out to the controllers of both the highest and second highest ranked hands for each pot.

A further object of the present invention is to allow the game players to compete directly against each other rather than each against the house or Player/Banker.

Another object of the present invention is to allow the game players to make wagers where they have even odds of winning against the other players.

A still further object of the present invention is to allow play of a wagering game without the need for a banker, player/banker, or the use of dice.

Yet another object of the invention is to allow players to make second-line, or "backline," wagers.

A further object of the present invention is to allow players to make fixed-limit wagers while allowing the player to win more than the wagered amount.

Other objects and advantages of the present invention will become apparent when the method for bet placement: and wager distribution of the present invention is considered in conjunction with the accompanying drawings, specification, and claims.

DESCRIPTION OF THE PREFERRED EMBODIMENT

Figure 1:
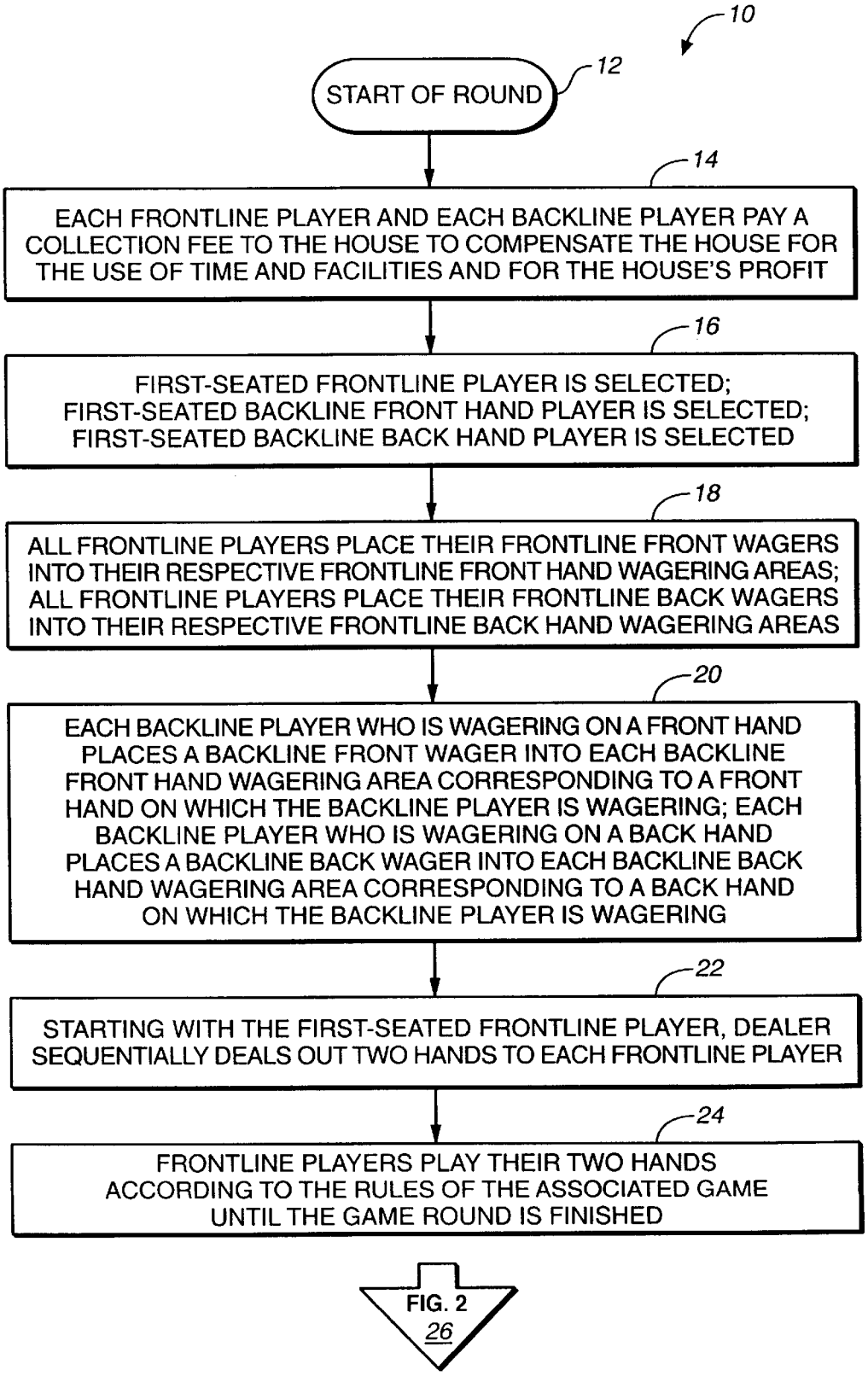
FIG. 1 is a flow diagram showing the initial sequence of steps comprising the inventive method Players' Action Pot.
Figure 2:
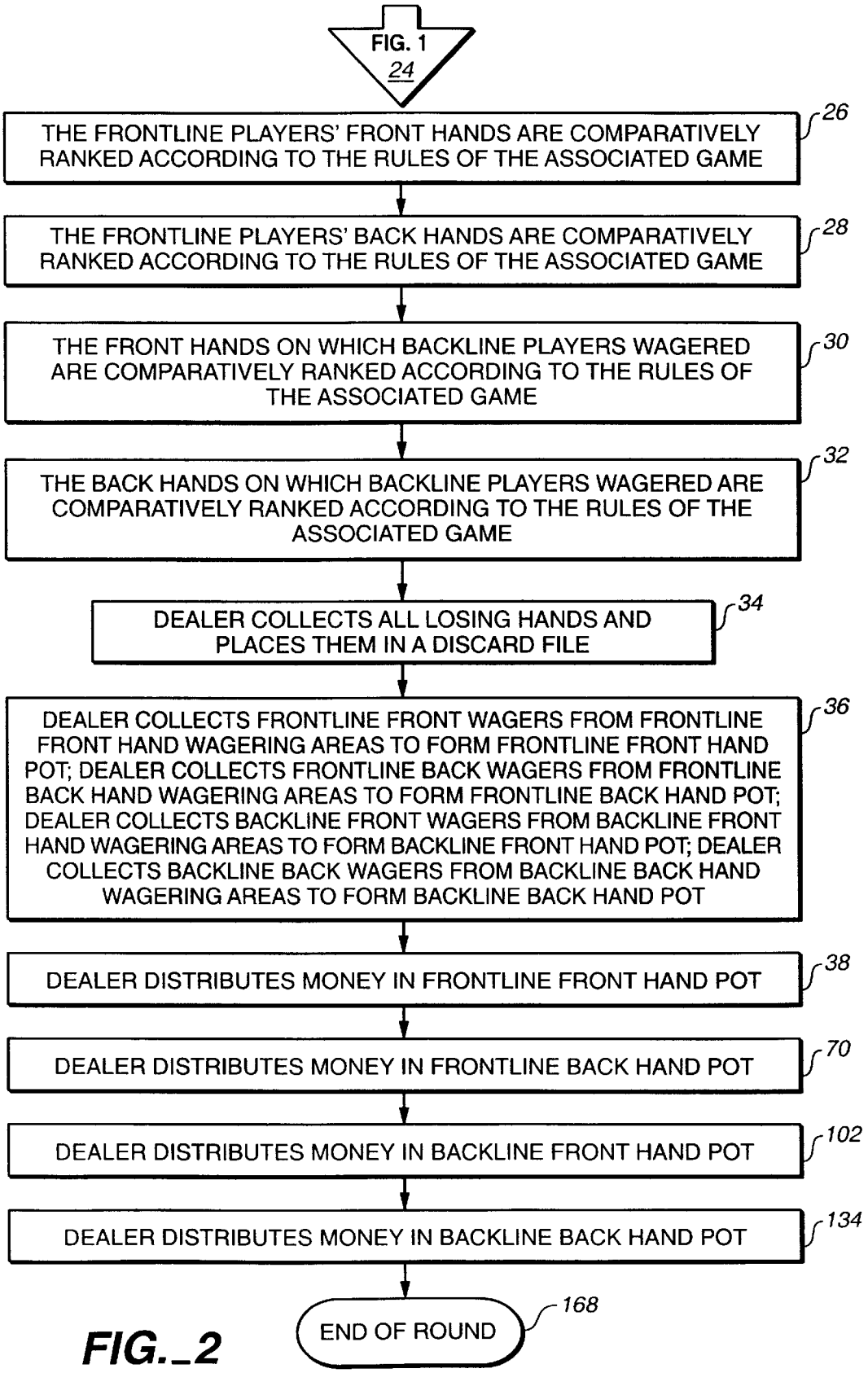
FIG. 2 is a flow diagram continuing the sequence of steps comprising the inventive method Players' Action Pot from FIG. 1.

FIGS. 1 and 2 portray a flow diagram of the order of steps used in the Players' Action Pot method 10. For purposes of discussion, it shall be assumed that the Players' Action Pot method 10 is used in conjunction with a card game such as Pai Gow Poker or Double Hand Poker, although it should be understood that the method may be used with any legal game played in rounds in which each active player controls two discrete "hands" each of which, at the end of play, may be ranked in comparison with other players' corresponding "hands". It should be noted that, while the term "hand" is used throughout this application to be consistent with the card game example, a "hand" for purposes of this application can be any holding of a player in a game, including but not limited to a collection of tiles, a dice roll, or a choice of a racer at a race.

Figure 3:
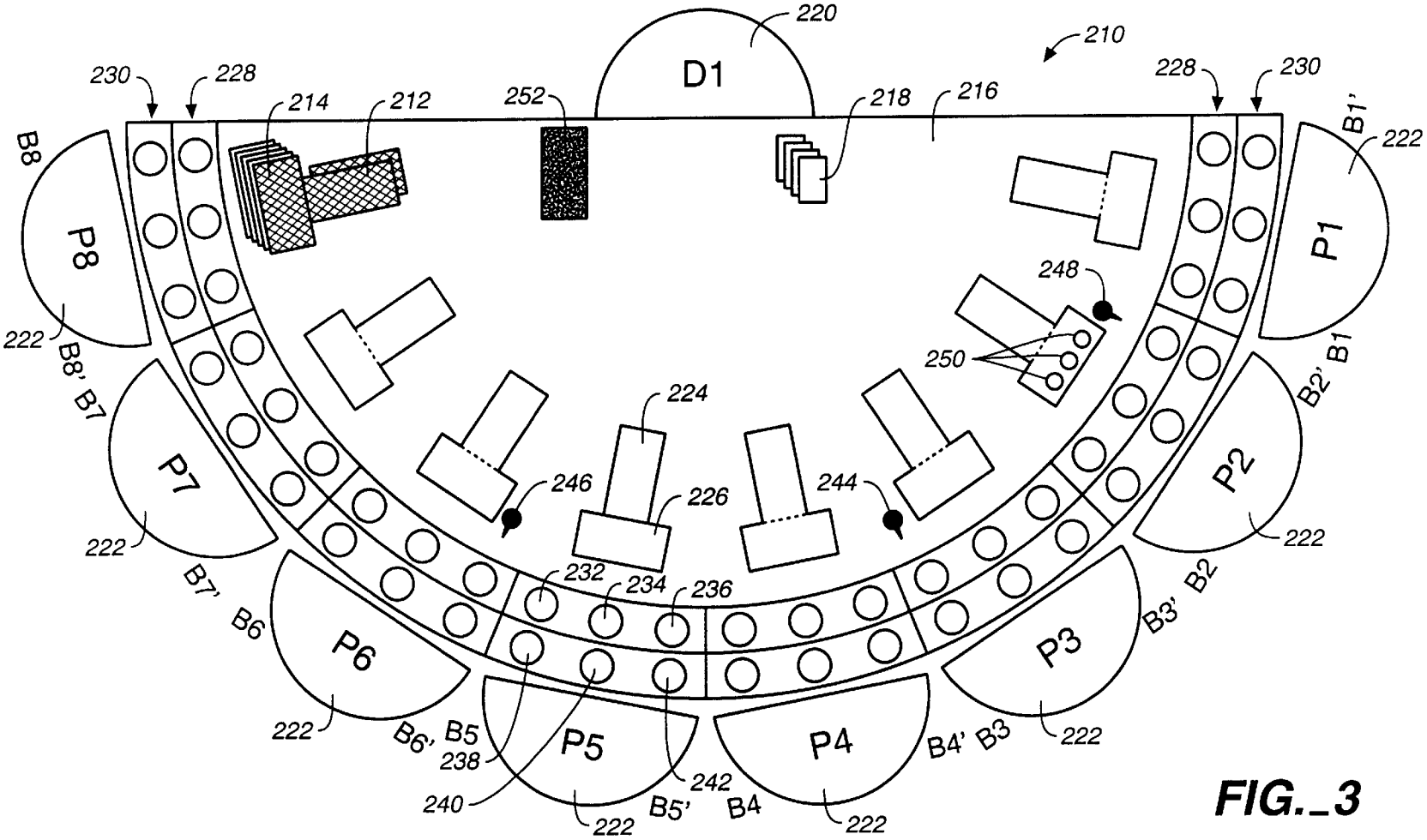
FIG. 3 is a plan view of the operation of Players' Action Pot in conjunction with a card game on a playing table designed for use with the Players' Action Pot method.

FIG. 3 shows generally the operation of Players' Action Pot with a card game 210. The players' front hands are designated 212, and the player's back hands are designated 214. In the preferred embodiment, the associated game is played at a table 216. Equipment used in play of the associated game is employed as needed. This could include, but is not limited to: a standard deck of fifty-two cards 218, several such standard decks, a special deck such as the deck used in California blackjack which has four additional special aces, several such special decks, or a collection of tiles as for Pai Gow or Dominoes.

In the preferred embodiment, a dealer D1 is chosen to control the deck of cards 218, identify winning hands, and collect all wagers. The dealer D1 is preferably a non-wagering, disinterested party. However, the invention encompasses play in which the role of dealer D1 is filled by a player.

In a preferred embodiment, two types of players may place wagers each round: "frontline" players P1-P8 and "backline" players B1-B8 and B1'-B8'. Frontline players P1-P8 are active in the game, receiving and controlling hands 212 and 214. Backline players B1-B8 and B1'-B8' wager on the relative final ranking of the hands of frontline players P1-P8 against the other backline players. Note that the inclusion of backline players is preferred but is not necessary to the present invention.

When backline play is allowed, backline players B1-B8 and B1'-B8' have the right to collaborate with frontline players P1-P8 in controlling play of hands 212 and 214. However, frontline players P1-P8 have the right to make the final decisions on play of hands 212 and 214. It should be understood that the method of the present invention allows house rules to determine whether each frontline player has the right to refuse to allow another player to select the frontline player's hand for backline play.

The number of frontline players may be limited by the number of decks used in a card game, or by the rules of the game; limits on the number of backline players and further limits on the number of frontline players are posed only by factors of convenience. For clarity, the embodiment described here establishes a limit of eight frontline players P1-P8 and sixteen backline players B1-B8 and B1'-B8', but it is to be understood that the Players' Action Pot method may be used with any number of frontline players exceeding one.

It is to be understood that a single person may serve as multiple frontline players, as multiple backline players, or both as frontline and backline players, as long as that person wagers separate amounts for each player position. For purposes of this application, such single persons shall be treated as if each player position controlled by that single person were a distinct frontline or backline player.

In the preferred embodiment, table 216 identifies a dealer's seat 220 and a number of players' seat positions 222 equal to the maximum number of frontline players P1-P8, here eight. Preferably table 216 defines placement areas 224 and 226 such that front hands 212 are placed in area 224 and back hands 214 are placed in area 226. Table 214 also provides two rows of wagering areas extending around the table in front of players' seat positions 222, a frontline wagering row 228, and a backline wagering row 230. In a preferred embodiment, corresponding to each players' seat position 222, the frontline wagering row 228 defines three wagering areas: one for the frontline player's front wager 232, and two for backline players' wagers on that front hand 234 and 236. Similarly, the backline wagering row 230 defines three wagering areas: one for the frontline player's back wager 238, and two for backline players' wagers on that back hand 240 and 242. It should be understood, however, that the wagering areas into which frontline and backline players place their wagers do not have to take this configuration, but can be situated in any manner such that the dealer and/or the players can clearly identify which person placed which wager on what hand.

Referring to FIGS. 1 and 3, the Players' Action Pot method begins with step 12, the start of a round of play of the game. At that time, the dealer D1 identifies which frontline players P1-P8 and backline players B1-B8 and B1'-B8' wish to participate in that round of play. In a preferred embodiment, step 12 includes giving a unique identifying position to each frontline player P1-P8 such as seat positions 222. Where each frontline player is a distinct person, each frontline player sits in the seat having that player's identifying number.

Note that if any one person is playing as multiple frontline players as described above, that person cannot sit at each seat position controlled by that player. Preferably, in that situation, that person sits at one of the seat positions corresponding to that person's frontline player positions and represents to dealer D1 that that person is playing the other frontline player positions. Dealer D1 then ensures that no other person sits at the seat positions corresponding to the other frontline player positions.

In a preferred embodiment particularly useful for casino play, a step 14 is included in which each frontline player and each backline player pays a collection fee 250 to the house to compensate the casino for the use of the casino's time and facilities and for the casino's profit in operating the game. In operation with table 216, collection fees may be placed into card placement areas 226 for easy identification. It should be understood that collection fees 250 could consist of individual fees paid by each frontline and backline player dependent upon the amount of time each player has spent at the table, of a predetermined fee amount for each hand of frontline or of backline play, or of a percentage of the frontline wagers and backline wagers, or some combination of the above. These fees could also be in addition to a cover charge for entrance into the casino facility. Preferably the dealer takes in collection fees 250 and places them into a collection pot 252.

In step 16, the play order of frontline players P1-P8 is determined by choosing a first-seated player and having the play order rotate from the first-seated player. Preferably, the frontline players P1-P8 are seated in a roughly circular fashion such as at table 216, and the sequential frontline order proceeds clockwise from the first-seated player. However, it should be understood that the sequential frontline order could also proceed counterclockwise or according to some other preset ordering scheme. The first time a first-seated frontline player is selected, the selection may be by any means: randomly, by a dice roll, or by a conventional seat position choice. Preferably, thereafter the position of first-seated player moves one step along the rotation between rounds of the game so that each player has the opportunity to play from every player position. In a preferred embodiment, step 16 includes placing a frontline marker 244, which could include a button or a disc, in front of the first-seated player to identify the current first-seated player.

Preferably two sequential backline orders are also created to allow a mechanism by which to distribute "odd" chips in the backline pots equitably, as will be described subsequently as part of the preferred wager distribution schemes. Both a first-seated backline front hand player and a first-seated backline back hand player are selected. Again, any means may be used to select the first first-seated players, such as at random, by a dice roll, or by the first player to place his or her wager on the table. A sequential backline front order and a sequential backline back order are then established. When the inventive method is in use with a table such as table 216, the sequential backline front order may be established by moving clockwise (or counterclockwise) around the table through the players corresponding to backline wagering areas 234 and 236, and the sequential backline back order may be established by moving clockwise (or counterclockwise) around the table through the players corresponding to backline wagering areas 240 and 242. However, any other preset ordering schemes could be used. The position of first-seated backline front hand player and first-seated backline back hand player then each preferably move one step forward through their respective ordering scheme on each round. Backline front marker 246 and backline back marker 248 may be used to keep track of the current positions of first-seated backline front hand player and first-seated backline back hand player.

In step 18, each frontline player places a frontline front wager into that player's frontline front wagering area 232. Preferably each player's frontline front wager is of an equal amount. Each frontline player then places a frontline back wager into that player's frontline back wagering area 238. Preferably each player's frontline back wager is of an equal amount.

In step 20, each backline player identifies and wagers on the front or back hand on which that backline player wishes to bet. The number of backline players allowed to bet on any particular hand may be limited by the house; for example, when the game is played in conjunction with the table layout depicted in FIG. 3, it will be convenient for the house to limit the number to two, so that the number of backline wagers for a given hand will not exceed the number of wagering areas, 234 and 236 for a front hand and 240 and 242 for a back hand, for that hand. To accomplish the identification, each backline player who is wagering on a front hand places a backline front wager amount into one of the corresponding wagering areas 234 and 236. Preferably each backline front wager is of an equal amount. Then, each backline player who is wagering on a back hand places a backline back wager amount into one of the corresponding wagering areas 240 and 242. Preferably each backline back wager is of an equal amount. In a preferred embodiment, each backline player may identify which wager that backline player placed by standing behind the seat position of the frontline player on whom the backline player wagered.

Note that if any one person is playing as multiple backline players or as both a frontline and a backline player, as described above, that person cannot stand behind each frontline player on whom the backline player bet. Preferably, in that situation, that person represents to dealer D1 that that person is playing each of the backline player positions. Dealer D1 then keeps track of which person is in control of each backline wager.

Both the frontline and backline wager amounts may be determined separately by the frontline and backline players respectively each round. However, to forestall conflicts between players, in a preferred embodiment, table limits set specific frontline and backline wager amounts. For example, table 214 could set the frontline front wager to forty-eight dollars the frontline back wager to twenty-four dollars, the backline front wager to twelve dollars, and the backline back wager to six dollars.

Note that in the embodiment described here, the steps following step 12 and preceding step 22 are in the order step 14, step 16, step 18, and step 20. However, steps 14, 16, 18, and 20 are independent of each other and these four steps may be conducted in any order.

In step 22, the dealer begins play of the associated game by sequentially dealing "two hands" to each frontline player, beginning with the first-seated frontline player. In the context of card games, it should be understood that dealing "two hands" incorporates the practice where the dealer actually deals one set of cards to each frontline player, and each frontline player then divides the cards into two separate hands according to that player's strategy. In other game contexts, such as in tile games, similar player division of one hand dealt into two hands is also anticipated.

In step 24, play of the game proceeds until the frontline players have finished play. Depending on the rules of the associated game, step 24 may include wagering of additional amounts by the frontline players and/or backline players as part of play; for example, in poker-type card games frontline players may place or match "raise" wagers.

Referring to FIG. 2, in step 26, the dealer ranks all the frontline players' front hands comparatively against each other according to the rules of the associated game. In step 28, the dealer ranks all the frontline players' back hands comparatively against each other according to those rules. In step 30, the front hands on which backline players wagered are comparatively ranked, and in step 32, the back hands on which backline players wagered are comparatively ranked. Note that, as not every front or back hand may have been wagered on by a backline player, the highest ranked backline front hand could have a lesser rank than the highest ranked frontline front hand if no backline wager was made on the highest ranked frontline front hand. The frontline comparative rankings may include ties if the rules of the associated game so allow; the backline comparative rankings will include ties where multiple backline players bet on the same hand or on different tying hands.

Once the comparative rankings for all the frontline and backline hands are established, preferably a step 34 is included wherein the dealer collects the losing hands and places them into a discard pile.

At this point, the monies wagered are readied for distribution. The frontline front wagers form the frontline front hand pot, the frontline back wagers form the frontline back hand pot, the backline front wagers form the backline front hand pot, and the backline back wagers form the backline back hand pot. Preferably, in step 36, the dealer collects these four pots physically into areas on table 216 to make distribution of these pots more simple.

In steps 38, 70, 102, and 134 the monies in each pot are distributed among the highest-ranked and second-highest ranked frontline and backline players for each pot according to predetermined formulas for each pot. In the preferred embodiment, the predetermined formulas for the distribution of each pot operate in fundamentally the same manner, which is described as follows. It should be noted that distribution is meant to include giving no portion of a pot to a set of players: so, for example, predetermined formulas can be used which provide that in some instances the distribution allocates all of the pot between the highest-ranked players and none to the second-highest ranked players. It should further be understood that the Players' Action Pot method 10 may also be used with different proportions of winnings between the highest and second-highest ranked players in the distribution of each pots than is described below in the preferred embodiment. A generalized summary of the manner of distribution of both pots follows; the specifics of the distribution methods will then be presented in relation to the flow diagrams of FIGS. 4, 5, 6, 7, 8, 9, 10, and 11.

To summarize the preferred distribution method generally: in the preferred embodiment, the exact distributions of each pot will vary depending on the number of players contributing to the pot. If two or three players have contributed to the pot, the player with the highest ranked hand wins that entire pot; if there is a tie for the highest ranked hand, each tying player receives an equal share of that pot. If four or more players have contributed to the pot, there is no "winner takes all": the dealer determines both a highest rank and a second highest rank among those players. If more than one player has a hand of the highest rank, those players split that pot equally, and the distribution is finished with nothing going to the second-highest ranked player. Otherwise, the player with the hand of the highest rank takes two-thirds of the pot, and the remaining one-third is distributed to the player or players of the second-highest rank. If more than one player has a hand of the second-highest rank, the dealer distributes the last one-third of that pot in equal shares to those players. Otherwise, the player with the hand of the second-highest rank takes the entire last one-third of the pot. Detailed descriptions of the exact steps of distributing each pot follow.

Figure 4:
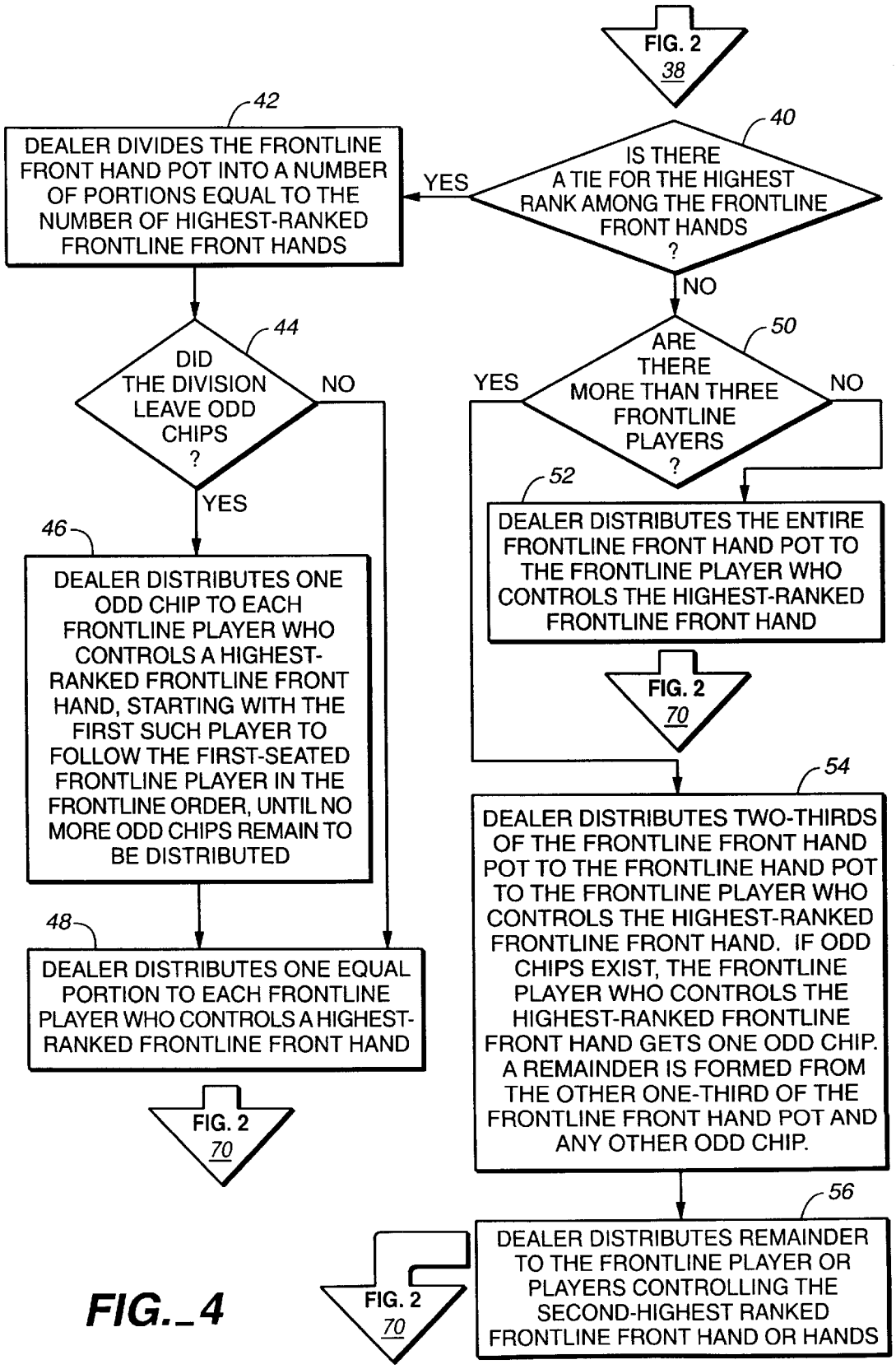
FIG. 4 is a flow diagram showing the sequence of steps of distributing the frontline front hand pot among frontline players receiving the primary share of the winnings of that pot.
Figure 5:
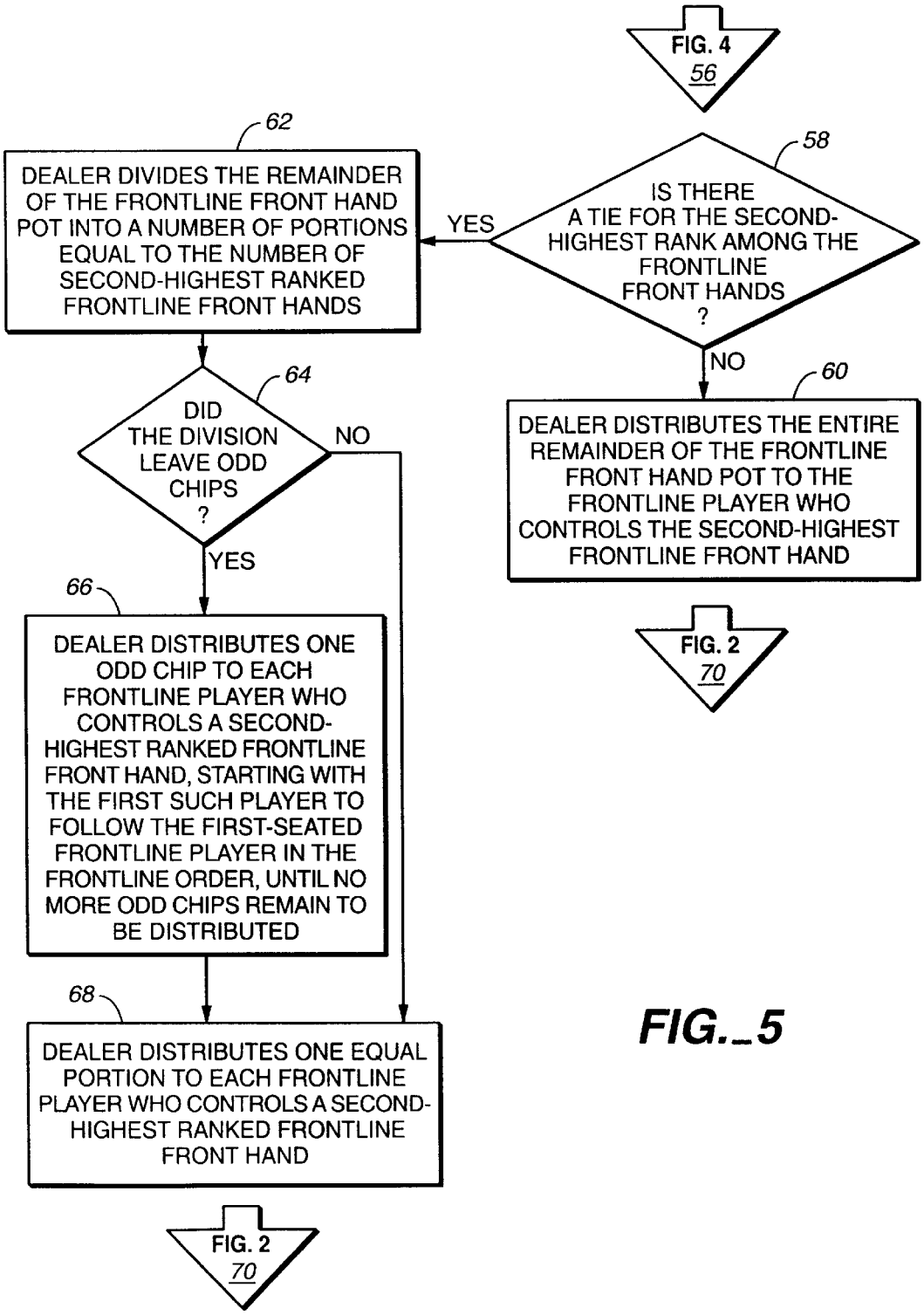
FIG. 5 is a flow diagram showing the sequence of steps of distributing the remainder of the frontline front hand pot among the frontline players receiving a secondary share of the winnings of that pot.

In step 38, the dealer directs distribution of the money in the frontline front hand pot according to a predetermined frontline front hand formula. Step 38 is broken down into substeps 40 through 68 as shown in FIGS. 4 and 5.

In substep 40, the dealer determines whether there was a tie for the highest rank among the frontline front hands. If so, the dealer proceeds to substep 42. In substep 42, the dealer divides the frontline front hand pot into a number of equal portions equal to the number of frontline front hands having the highest rank, leaving any odd chips which cannot be divided equally into the equal portions aside. In substep 44, the dealer determines whether there were any such odd chips. If so, in substep 46, the dealer distributes one odd chip to each frontline player controlling a highest-ranked frontline front hand, starting with the first such player to follow the first-seated frontline player in the sequential frontline order and continuing through the sequential frontline order until there are no more odd chips to distribute. Then, in substep 48, the dealer distributes one of the equal portions of the frontline front hand pot to each frontline player controlling a highest-ranked frontline front hand. At that point, the preferred embodiment of step 38 is complete.

If, at substep 44, no odd chips exist, then the predetermined frontline front hand formula proceeds directly to substep 48.

If, at substep 40, there was only one frontline front hand of the highest rank, the predetermined frontline front hand formula proceeds to substep 46. As the exact distributions paid to each player differ in the preferred embodiment depending on whether there are more than three frontline front hand players involved in the game, in substep 50 the dealer determines whether there are more than three frontline front hand players. If there are only two or three frontline front hand players, substep 52 is applied, and the dealer distributes all the money in the frontline front hand pot to the frontline player controlling the highest-ranked frontline front hand. The preferred embodiment of step 38 is then complete.

If, at substep 50, the dealer determines that there are more than three frontline front hand players, in substep 54 the frontline front hand pot is divided into three equal portions. Two of these portions are distributed to the frontline player controlling the highest-ranked frontline front hand, and one is reserved as a remainder for distribution to the one or more frontline players controlling a second-highest ranked frontline front hand in substep 56. For a division into three parts, there can be only one or two odd chips; if there are any odd chips, one is distributed to the frontline player controlling the highest-ranked frontline front hand, and one is reserved for the remainder of the frontline front hand pot.

Substep 56 is pictured in further substeps in FIG. 5. The first substep of substep 56 is substep 58, which determines whether there are a plurality of frontline front hands having the second highest rank. If not, in substep 60 the dealer distributes the remainder of the frontline front hand pot to the frontline player controlling the second-highest ranked frontline front hand. At that point, the preferred embodiment of step 34 is complete.

If there are a plurality of frontline front hands having the second highest rank, in substep 62 the dealer divides the remainder of the frontline front hand pot into a number of equal portions equal to the number of second-highest ranked frontline front hands, leaving any odd chips which cannot be divided equally into the equal portions aside. In substep 64, the dealer determines whether there were any such odd chips. If so, in substep 66, the dealer distributes one odd chip to each frontline player controlling a frontline front hand of the second highest rank, starting with the first such player who follows the first-seated frontline player in the sequential frontline order and continuing through the sequential frontline order, until there are no more odd chips to distribute. Then, in substep 68, the dealer distributes one of the equal portions of the frontline front hand pot to each frontline player controlling a frontline front hand of the second-highest rank. The preferred embodiment of step 38 is then complete.

If, at substep 64, no odd chips exist, then the predetermined frontline front hand formula proceeds directly to substep 68.

Figure 6:
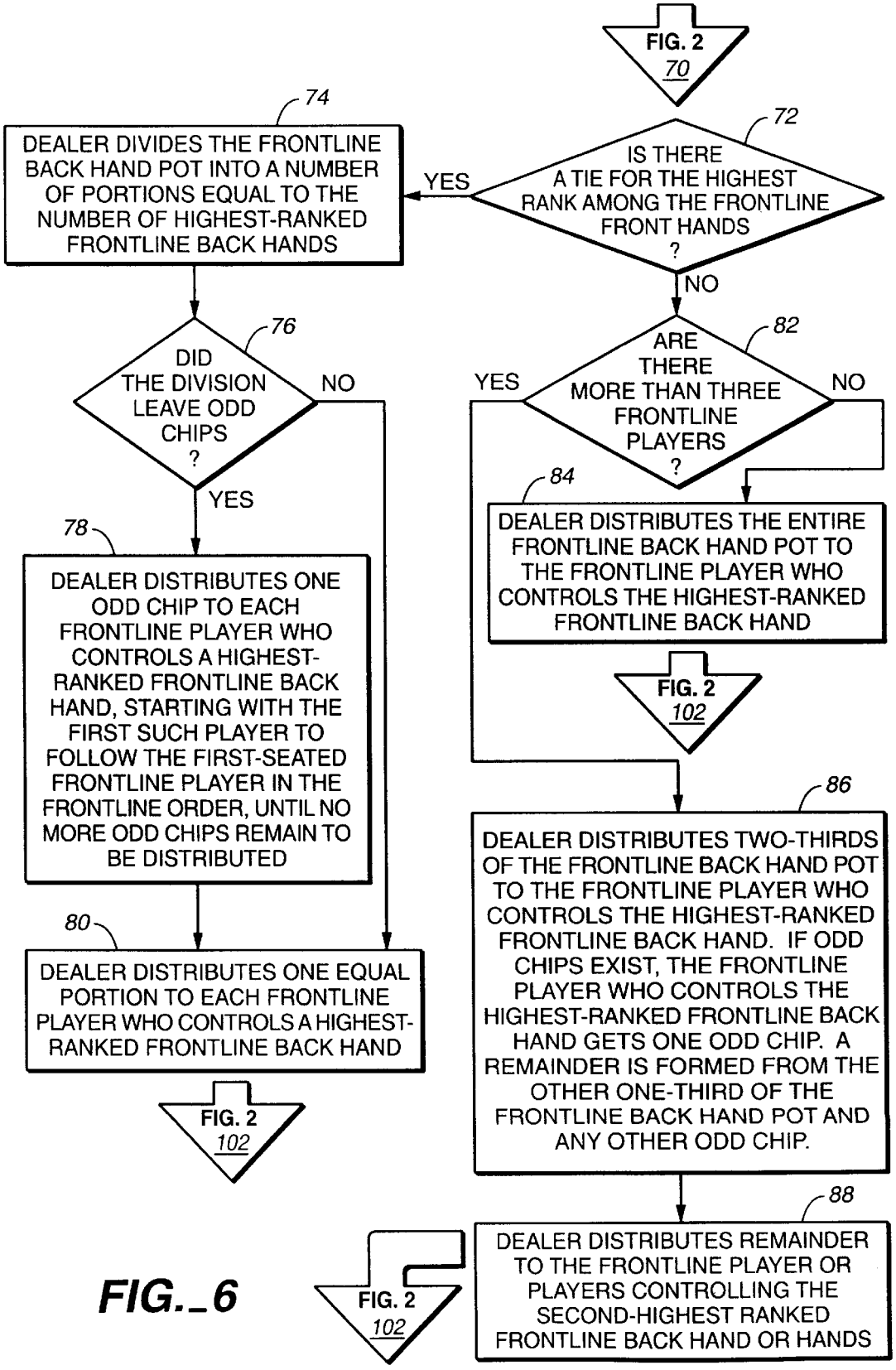
FIG. 6 is a flow diagram showing the sequence of steps of distributing the frontline back hand pot among the frontline players receiving the primary share of the winnings of that pot.
Figure 7:
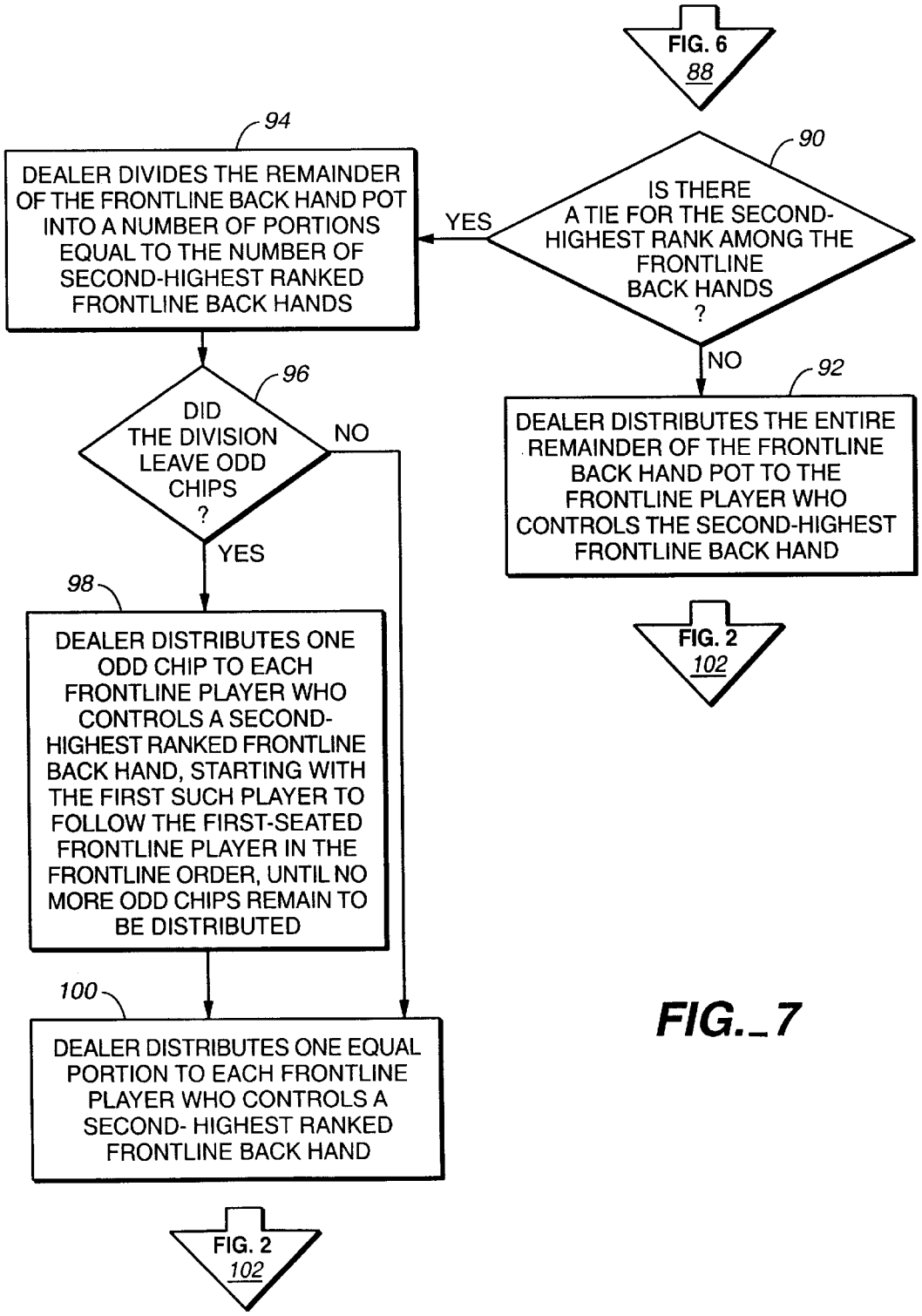
FIG. 7 is a flow diagram showing the sequence of steps of distributing the remainder of the frontline back hand pot among the frontline players receiving a secondary share of the winnings of that pot.

At this point, all of the funds in the frontline front hand pot will have been distributed. Proceeding on to step 70, the dealer directs distribution of the money in the frontline back hand pot according to a predetermined frontline back hand formula. Step 70 is broken down into substeps 72 through 100 as shown in FIGS. 6 and 7.

In substep 72, the dealer determines whether there was a tie for the highest rank among the frontline back hands. If so, the dealer proceeds to substep 74. In substep 74, the dealer divides the frontline back hand pot into a number of equal portions equal to the number of frontline back hands having the highest rank, leaving any odd chips which cannot be divided equally into the equal portions aside. In substep 76, the dealer determines whether there were any such odd chips. If so, in substep 78, the dealer distributes one odd chip to each frontline player controlling a highest-ranked frontline back hand, starting with the first such player to follow the first-seated frontline player in the sequential frontline order and continuing through the sequential frontline order until there are no more odd chips to distribute. Then, in substep 80, the dealer distributes one of the equal portions of the frontline back hand pot to each frontline player controlling a highest-ranked frontline back hand. At that point, the preferred embodiment of step 70 is complete.

If, at substep 76, no odd chips exist, then the predetermined frontline back hand formula proceeds directly to substep 80.

If, at substep 72, there was only one frontline back hand of the highest rank, the predetermined frontline back hand formula proceeds to substep 82. As the exact distributions paid to each player differ in the preferred embodiment depending on whether there are more than three frontline back hand players involved in the game, in substep 82 the dealer determines whether there are more than three frontline back hand players. If there are only two or three frontline back hand players, substep 84 is applied, and the dealer distributes all the money in the frontline back hand pot to the frontline player controlling the highest-ranked frontline back hand. The preferred embodiment of step 70 is then complete.

If, at substep 82, the dealer determines that there are more than three frontline back hand players, in substep 86 the frontline back hand pot is divided into three equal portions. Two of these portions are distributed to the frontline player controlling the highest-ranked frontline back hand, and one is reserved as a remainder for distribution to the one or more frontline players controlling a second-highest ranked frontline back hand in substep 88. For a division into three parts, there can be only one or two odd chips; if there are any odd chips, one is distributed to the frontline player controlling the highest-ranked frontline back hand, and one is reserved for the remainder of the frontline back hand pot.

Substep 88 is pictured in further substeps in FIG. 7. The first substep of substep 88 is substep 90, which determines whether there are a plurality of frontline back hands having the second highest rank. If not, in substep 92 the dealer distributes the remainder of the frontline back hand pot to the frontline player controlling the second-highest ranked frontline back hand. At that point, the preferred embodiment of step 70 is complete.

If there are a plurality of frontline back hands having the second highest rank, in substep 94 the dealer divides the remainder of the frontline back hand pot into a number of equal portions equal to the number of second-highest ranked frontline back hands, leaving any odd chips which cannot be divided equally into the equal portions aside. In substep 96, the dealer determines whether there were any such odd chips. If so, in substep 98, the dealer distributes one odd chip to each frontline player controlling a frontline back hand of the second highest rank, starting with the first such player who follows the first-seated frontline player in the sequential frontline order and continuing through the sequential frontline order, until there are no more odd chips to distribute. Then, in substep 100, the dealer distributes one of the equal portions of the frontline back hand pot to each frontline player controlling a frontline back hand of the second-highest rank. The preferred embodiment of step 70 is then complete.

If, at substep 96, no odd chips exist, then the predetermined frontline back hand formula proceeds directly to substep 100.

Figure 8:
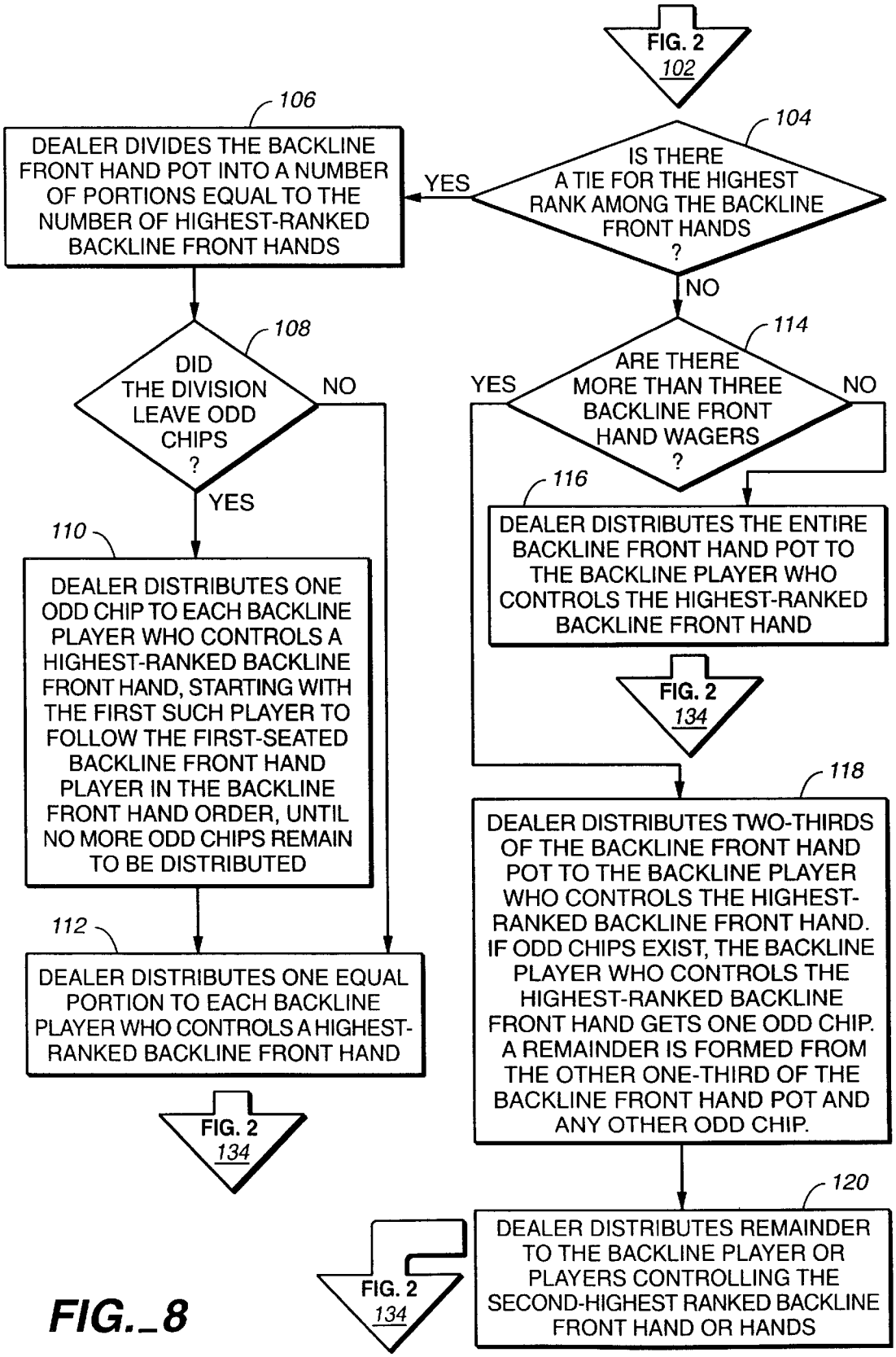
FIG. 8 is a flow diagram showing the sequence of steps of distributing the backline front hand pot among the backline players receiving the primary share of the winnings of that pot.
Figure 9:
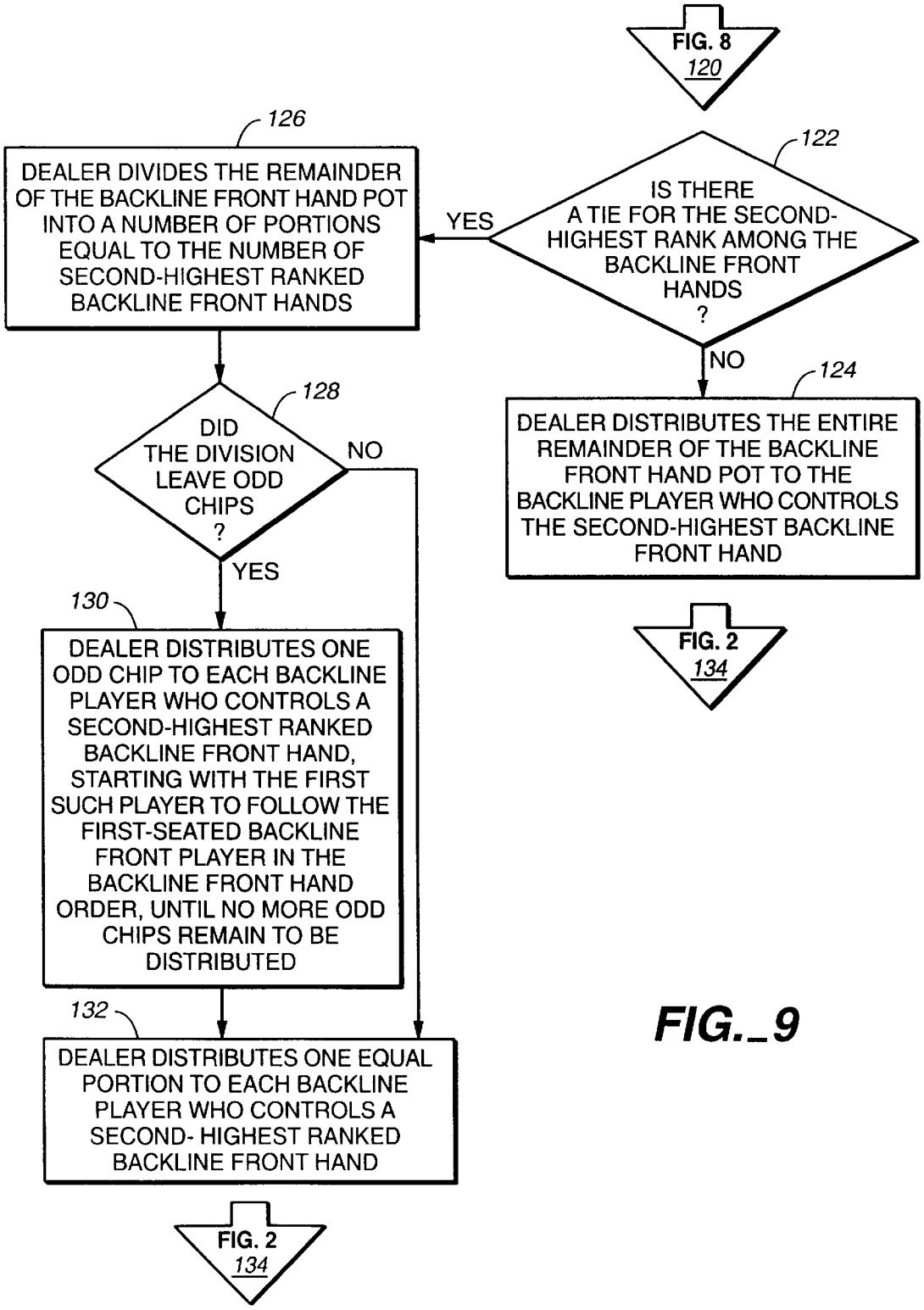
FIG. 9 is a flow diagram showing the sequence of steps of distributing the remainder of the backline front hand pot among the backline players receiving a secondary share of the winnings of that pot.

At this point, all of the funds in the frontline back hand pot will have been distributed. Proceeding on to step 102, the dealer directs distribution of the money in the backline front hand pot according to a predetermined backline front hand formula. Step 102 is broker down into substeps 104 through 132 as shown in FIGS. 8 and 9.

In substep 104, the dealer determines whether there was a tie for the highest rank among the backline front hands. If so, the dealer proceeds to substep 106. In substep 106, the dealer divides the backline front hand pot into a number of equal portions equal to the number of backline front hands having the highest rank, leaving any odd chips which cannot be divided equally into the equal portions aside. In substep 108, the dealer determines whether there were any such odd chips. If so, in substep 110, the dealer distributes one odd chip to each backline player controlling a highest-ranked backline front hand, starting with the first such player to follow the first-seated backline front hand player in the sequential backline front hand order and continuing through the sequential backline front hand order until there are no more odd chips to distribute. Then, in substep 112, the dealer distributes one of the equal portions of the backline front hand pot to each backline player controlling a highest-ranked backline front hand. At that point, the preferred embodiment of step 102 is complete.

If, at substep 108, no odd chips exist, then the predetermined backline front hand formula proceeds directly to substep 112.

If, at substep 104, there was only one backline front hand of the highest rank, the predetermined backline front hand formula proceeds to substep 114. As the exact distributions paid to each player differ in the preferred embodiment depending on whether there are more than three backline front hand players involved in the game, in substep 114 the dealer determines whether there are more than three backline front hand players. If there are only two or three backline front hand players, substep 116 is applied, and the dealer distributes all the money in the backline front hand pot to the backline player controlling the highest-ranked backline front hand. The preferred embodiment of step 102 is then complete.

If, at substep 114, the dealer determines that there are more than three backline front hand players, in substep 116 the backline front hand pot is divided into three equal portions. Two of these portions are distributed to the backline player controlling the highest-ranked backline front hand, and one is reserved as a remainder for distribution to the one or more backline players controlling a second-highest ranked backline front hand in substep 120. For a division into three parts, there can be only one or two odd chips; if there are any odd chips, one is distributed to the backline player controlling the highest-ranked backline front hand, and one is reserved for the remainder of the backline front hand pot.

Substep 120 is pictured in further substeps in FIG. 9. The first substep of substep 120 is substep 122, which determines whether there are a plurality of backline front hands having the second highest rank. If not, in substep 124 the dealer distributes the remainder of the backline front hand pot to the backline player controlling the second-highest ranked backline front hand. At that point, the preferred embodiment of step 102 is complete.

If there are a plurality of backline front hands having the second highest rank, in substep 126 the dealer divides the remainder of the backline front hand pot into a number of equal portions equal to the number of second-highest ranked backline front hands, leaving any odd chips which cannot be divided equally into the equal portions aside. In substep 128, the dealer determines whether there were any such odd chips. If so, in substep 130, the dealer distributes one odd chip to each backline player controlling a backline front hand of the second highest rank, starting with the first such player who follows the first-seated backline front hand player in the sequential backline front hand order and continuing through the sequential backline front hand order, until there are no more odd chips to distribute. Then, in substep 134, the dealer distributes one of the equal portions of the backline front hand pot to each backline player controlling a backline front hand of the second-highest rank. The preferred embodiment of step 102 is then complete.

If, at substep 128, no odd chips exist, then the predetermined backline front hand formula proceeds directly to substep 132.

Figure 10:
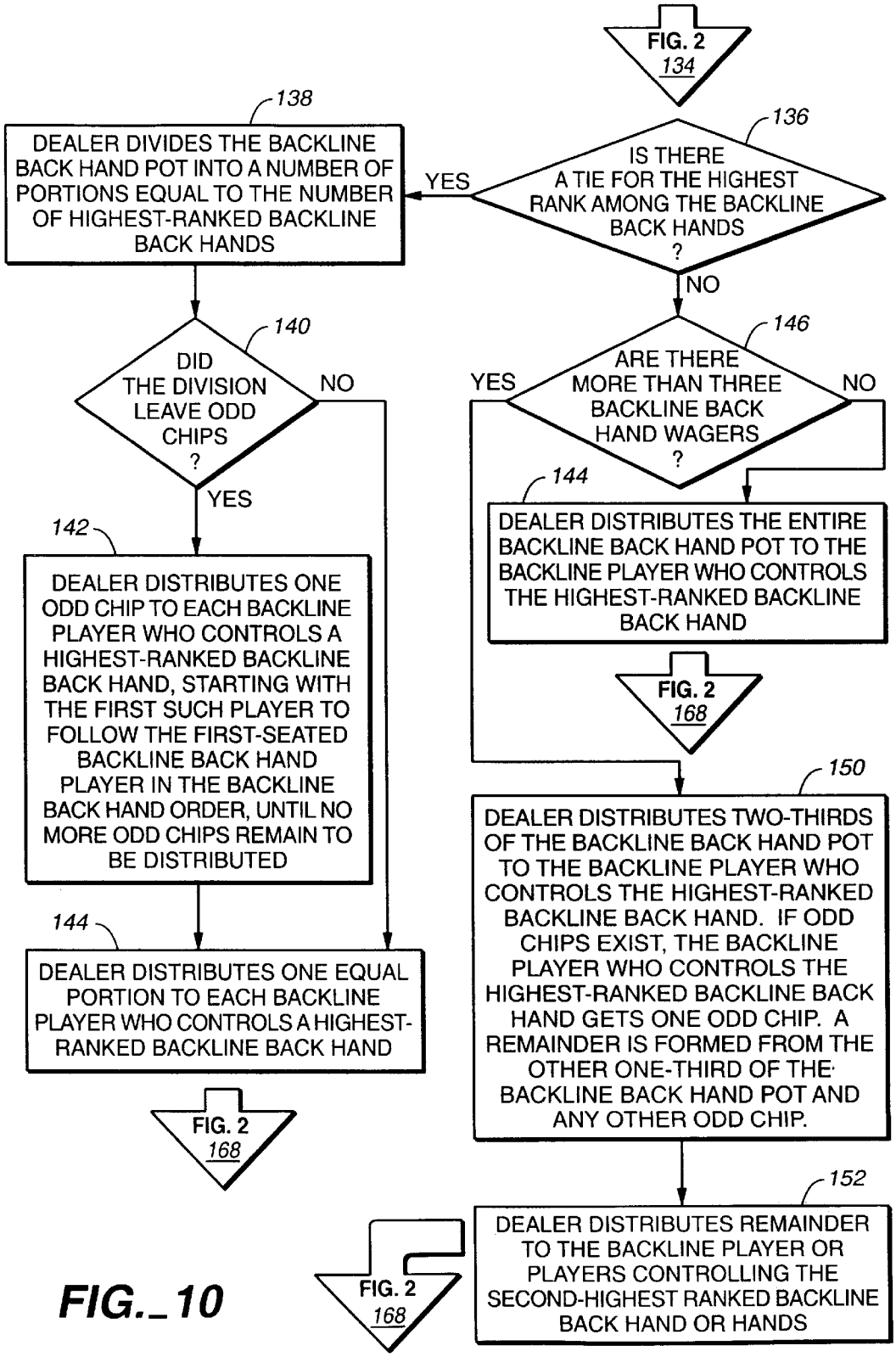
FIG. 10 is a flow diagram showing the sequence of steps of distributing the frontline front hand pot among frontline players receiving the primary share of the winnings of that pot.
Figure 11:
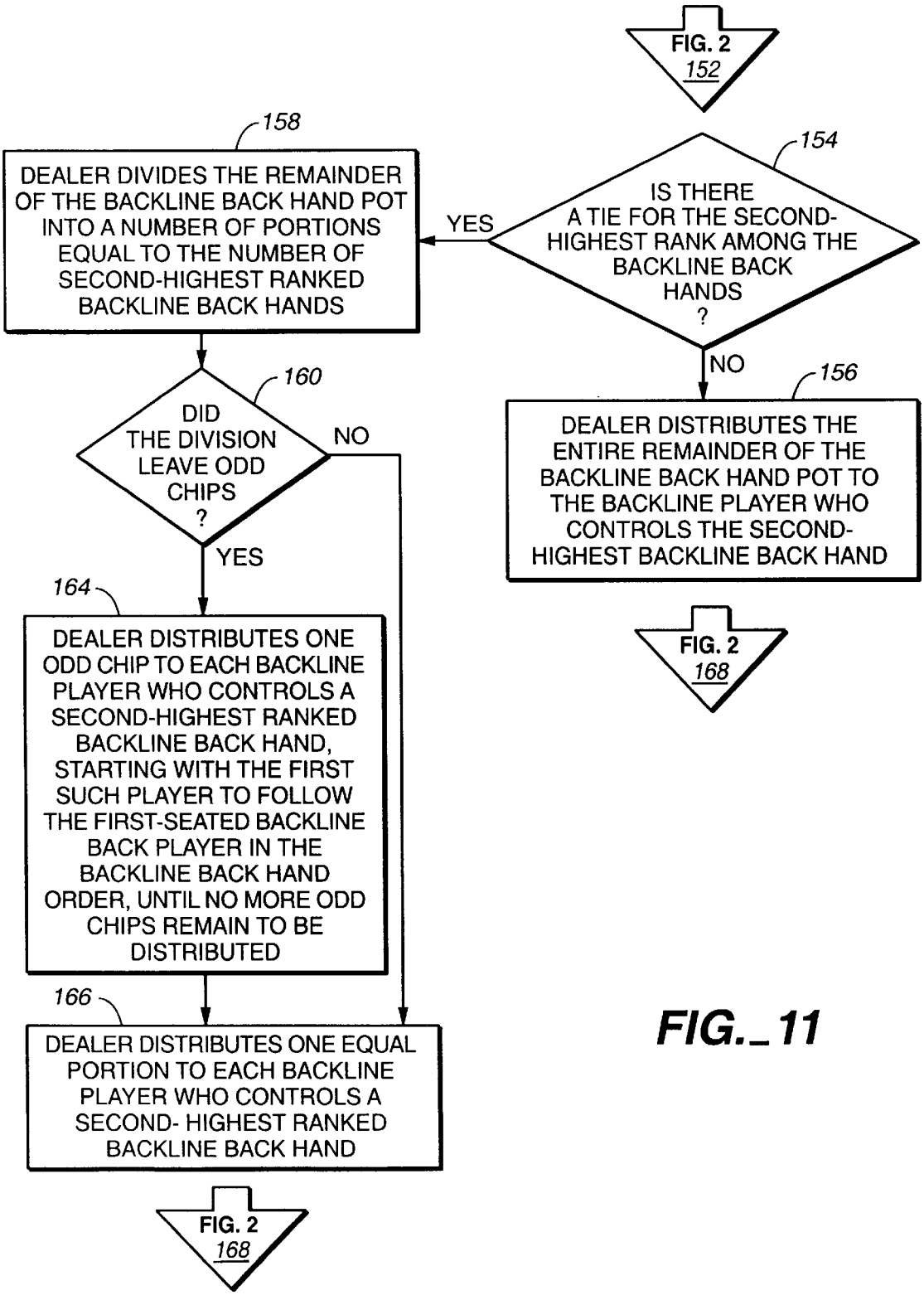
FIG. 11 is a flow diagram showing the sequence of steps; of distributing the remainder of the frontline front hand pot among frontline players receiving a secondary share of the winnings of that pot.

At this point, all of the funds in the backline front hand pot will have been distributed. Proceeding on to step 134, the dealer directs distribution of the money in the backline back hand pot according to a predetermined backline back hand formula. Step 134 is broken down into substeps 136 through 166 as shown in FIGS. 10 and 11.

In substep 136, the dealer determines whether there was a tie for the highest rank among the backline back hands. If so, the dealer proceeds to substep 138. In substep 138, the dealer divides the backline back hand pot into a number of equal portions equal to the number of backline back hands having the highest rank, leaving any odd chips which cannot be divided equally into the equal portions aside. In substep 140, the dealer determines whether there were any such odd chips. If so, in substep 142, the dealer distributes one odd chip to each backline player controlling a highest-ranked backline back hand, starting with the first such player to follow the first-seated backline back hand player in the sequential backline back hand order and continuing through the sequential backline back hand order until there are no more odd chips to distribute. Then, in substep 144, the dealer distributes one of the equal portions of the backline back hand pot to each backline player controlling a highest-ranked backline back hand. At that point, the preferred embodiment of step 134 is complete.

If, at substep 140, no odd chips exist, then the predetermined backline back hand formula proceeds directly to substep 144.

If, at substep 136, there was only one backline back hand of the highest rank, the predetermined backline back hand formula proceeds to substep 146. As the exact distributions paid to each player differ in the preferred embodiment depending on whether there are more than three backline back hand players involved in the game, in substep 146 the dealer determines whether there are more than three backline back hand players. If there are only two or three backline back hand players, substep 148 is applied, and the dealer distributes all the money in the backline back hand pot to the backline player controlling the highest-ranked backline back hand. The preferred embodiment of step 134 is then complete.

If, at substep 146, the dealer determines that there are more than three backline back hand players, in substep 150 the backline back hand pot is divided into three equal portions. Two of these portions are distributed to the backline player controlling the highest-ranked backline back hand, and one is reserved as a remainder for distribution to the one or more backline players controlling a second-highest ranked backline back hand in substep 152. For a division into three parts, there can be only one or two odd chips; if there are any odd chips, one is distributed to the backline player controlling the highest-ranked backline back hand, and one is reserved for the remainder of the backline back hand pot.

Substep 152 is pictured in further substeps in FIG. 11. The first substep of substep 152 is substep 154, which determines whether there are a plurality of backline back hands having the second highest rank. If not, in substep 156 the dealer distributes the remainder of the backline back hand pot to the backline player controlling the second-highest ranked backline back hand. At that point, the preferred embodiment of step 134 is complete.

If there are a plurality of backline back hands having the second highest rank, in substep 158 the dealer divides the remainder of the backline back hand pot into a number of equal portions equal to the number of second-highest ranked backline back hands, leaving any odd chips which cannot be divided equally into the equal portions aside. In substep 160, the dealer determines whether there were any such odd chips. If so, in substep 164, the dealer distributes one odd chip to each backline player controlling a backline back hand of the second highest rank, starting with the first such player who follows the first-seated backline back hand player in the sequential backline back hand order and continuing through the sequential backline back hand order, until there are no more odd chips to distribute. Then, in substep 166, the dealer distributes one of the equal portions of the backline back hand pot to each backline player controlling a backline back hand of the second-highest rank. The preferred embodiment of step 134 is then complete.

If, at substep 160, no odd chips exist, then the predetermined backline back hand formula proceeds directly to substep 166.

At this point, all of the funds in the backline back hand pot will have been distributed. Once step 166 is finished, the round is finished, as indicated by step 168. All the chips in the frontline front hand pot the frontline back hand pot, the backline front hand pot, and the backline back hand pot have been distributed, and a new round of play may commence with step 12.

Note that in the preferred embodiment described here, the steps 26, 28, 30, 32, 34, 36, 38, 70, 102, and 134 proceed in that order. However, these steps can be mixed in any order in which step 26 precedes step 38, step 28 precedes step 70, step 30 precedes step 102, and step 32 precedes step 134.

As stated above, one of the games with which the full inventive bet placement and wager distribution method may be played in conjunction with is Double Hand Poker. To adapt Double Hand Poker for use with the inventive method, the two-card hand formed by each frontline player is considered the "front" hand and the five-card hand formed by each backline player is considered the "back" hand. Because the players holding the highest-ranked front hands and the players holding the highest-ranked back hands each win their own pot, the players do not have to win both the front and back hands to win, and thus no pushed hands occur.

In a preferred simplified embodiment of the invention in combination with Double Hand Poker, Double Hand Poker may be played according to the inventive system as described above except for a variance with step 38, in which the dealer distributes the frontline front hand pot, step 70, in which the dealer distributes the frontline back hand pot, step 102, in which the dealer distributes the backline front hand pot, and step 134, in which the dealer distributes the backline back hand pot.

Figure 12:
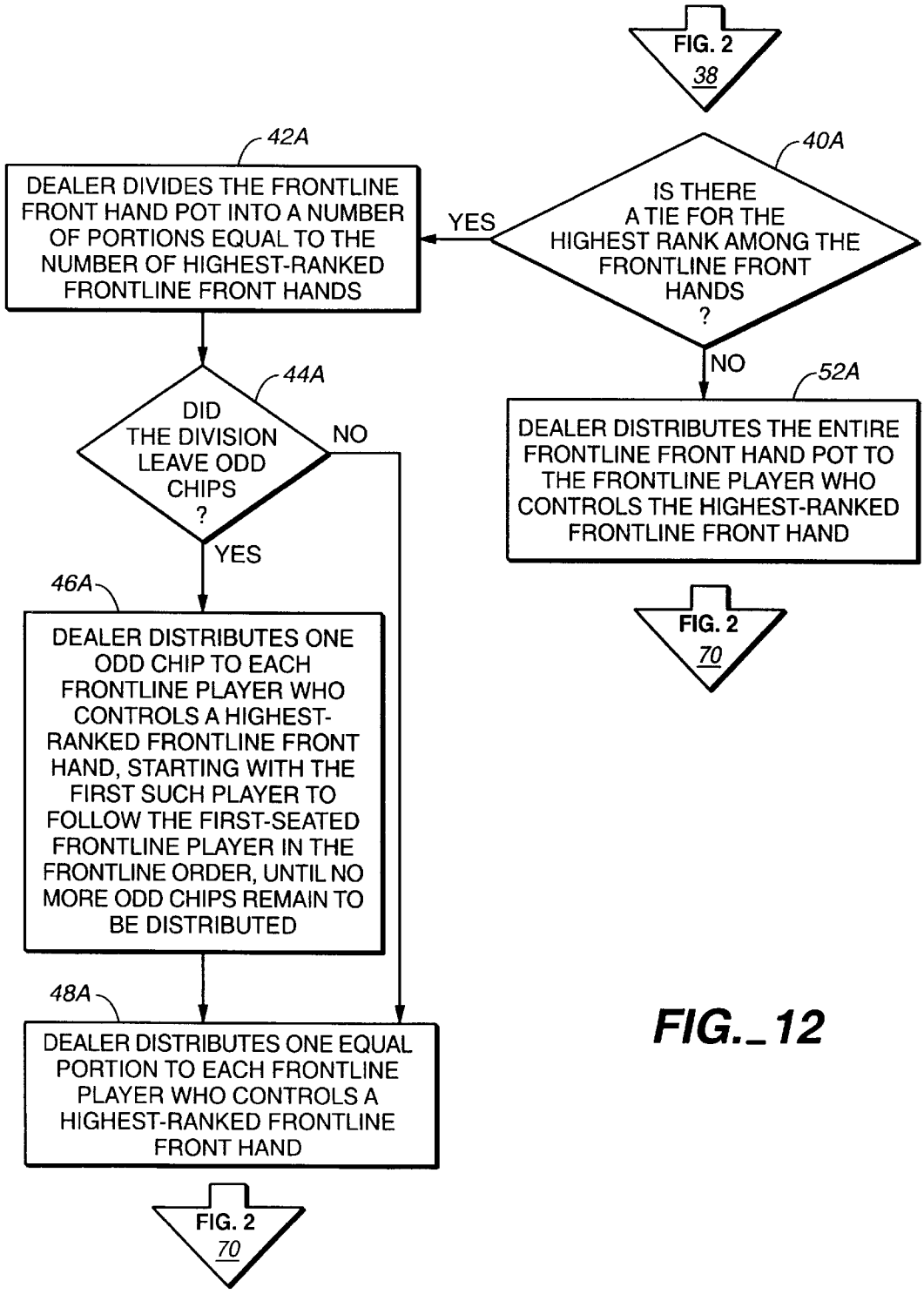
FIG. 12 is a flow diagram showing a simplified sequence of steps for distributing the frontline front hand pot for the inventive method in use in conjunction with Double Hand Poker.

Referring to FIG. 12, step 38 is instead broken down into substeps 40A, 42A, 44A, 46A, 48A, and 52A. In substep 40A, if there is no tie for the highest-ranked frontline front hand, the dealer proceeds to substep 52A, and distributes the entire frontline front hand pot to the frontline player controlling the highest-ranked frontline front hand. If there is a tie for the highest-ranked frontline front hand, the dealer splits the frontline front hand pot among the players controlling the tied hands according to steps 42A, 44A, 46A, and 48A identically as described above for steps 42, 44, 46, and 48 above in relation to FIG. 4.

Figure 13:
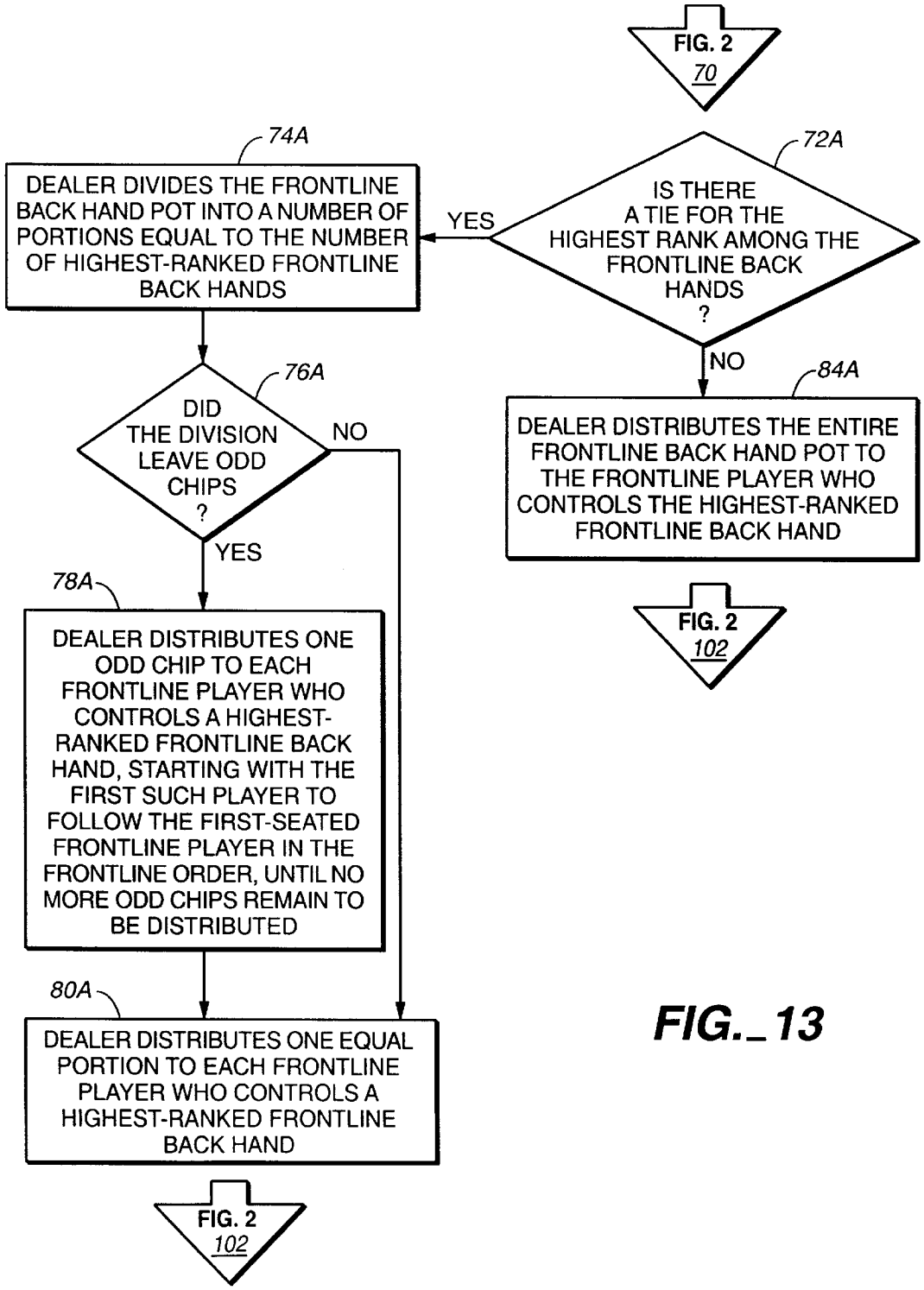
FIG. 13 is a flow diagram showing a simplified sequence of steps for distributing the frontline back hand pot for the inventive method in use in conjunction with Double Hand Poker.

Referring to FIG. 13, step 70 is instead broken down into substeps 72A, 74A, 76A, 78A, 80A, and 84A. In substep 72A, if there is no tie for the highest-ranked frontline back hand, the dealer proceeds to substep 84A, and distributes the entire frontline back hand pot to the frontline player controlling the highest-ranked frontline back hand. If there is a tie for the highest-ranked frontline back hand, the dealer splits the frontline back hand pot among the players controlling the tied hands according to steps 74A, 76A, 78A, and 80A identically as described above for steps 74, 76, 78, and 80 above in relation to FIG. 6.

Figure 14:
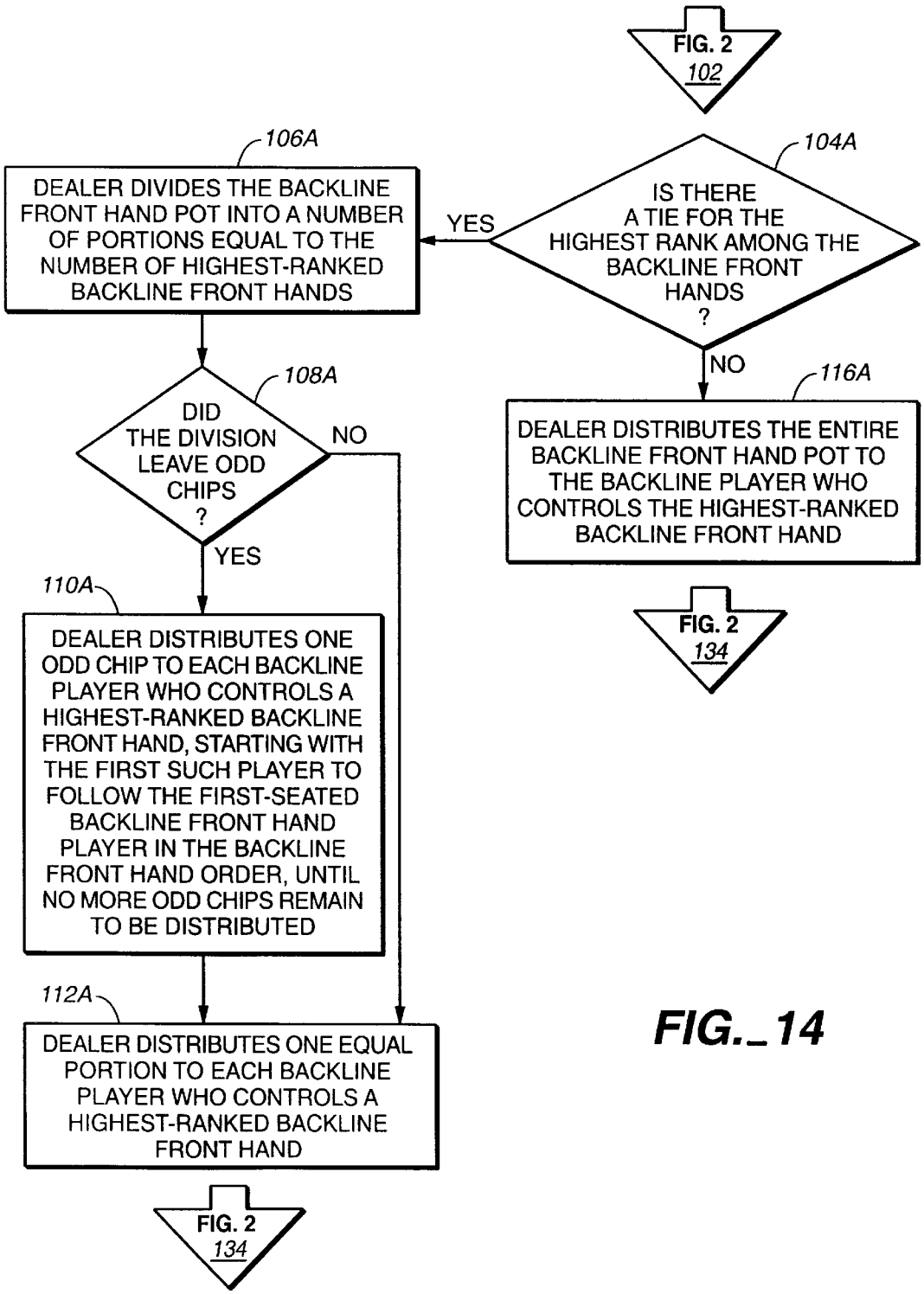
FIG. 14 is a flow diagram showing a simplified sequence of steps for distributing the backline front hand pot for the inventive method in use in conjunction with Double Hand Poker.

Referring to FIG. 14, step 102 is instead broken down into substeps 104A, 106A, 108A, 110A, 112A, and 116A. In substep 104A, if there is no tie for the highest-ranked backline front hand, the dealer proceeds to substep 116A, and distributes the entire backline front hand pot to the backline front hand player controlling the highest-ranked backline front hand. If there is a tie for the highest-ranked backline front hand, the dealer splits the backline front hand pot among the players controlling the tied hands according to steps 106A, 108A, 110A, and 112A identically as described above for steps 106, 108, 110, and 112 above in relation to FIG. 8.

Figure 15:
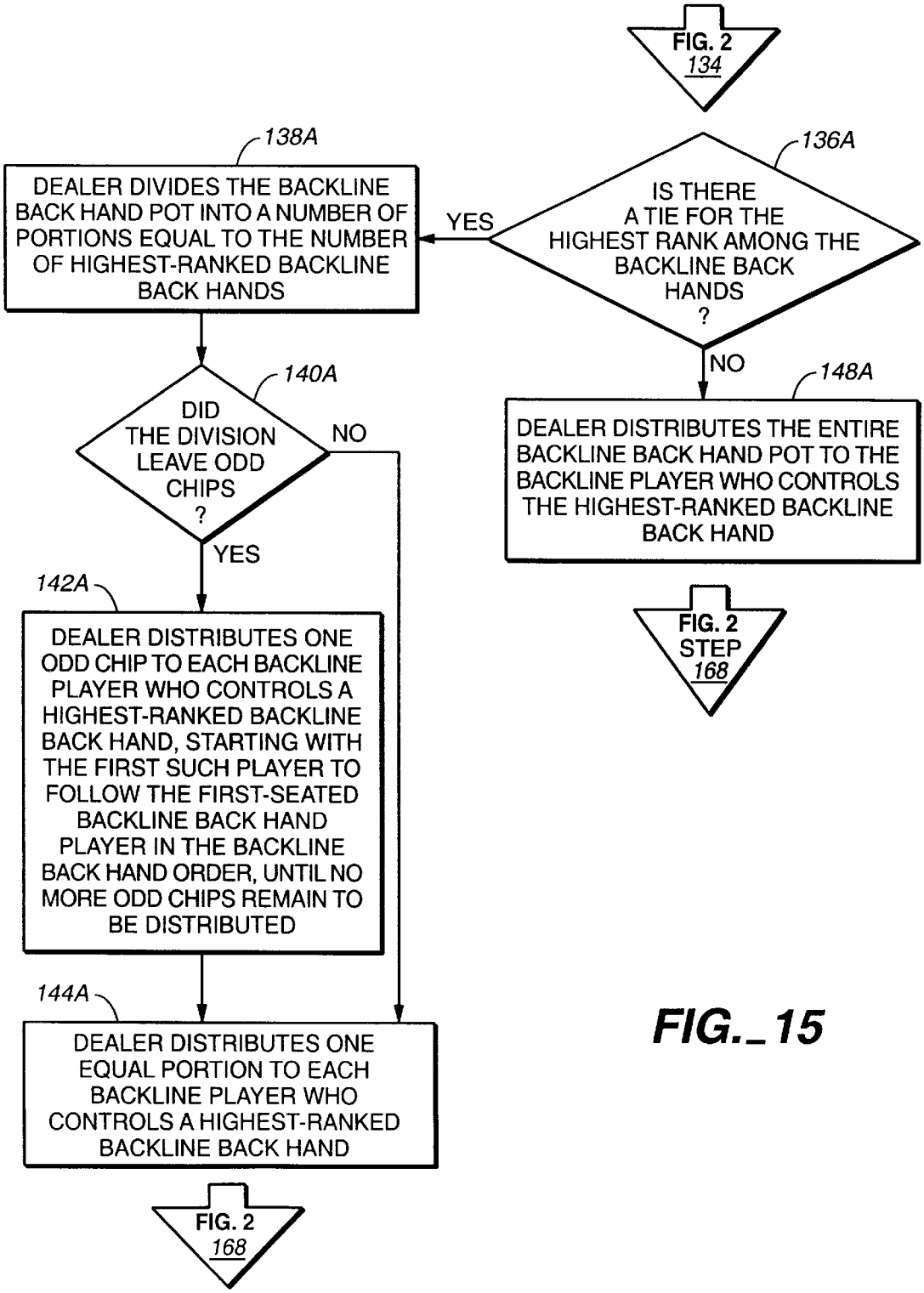
FIG. 15 is a flow diagram showing a simplified sequence of steps for distributing the backline back hand pot for the inventive method in use in conjunction with Double Hand Poker.

Referring to FIG. 15, step 134 is instead broken down into substeps 136A, 138A, 140A, 142A, 144A, and 148A. In substep 136A, if there is no tie for the highest-ranked backline back hand, the dealer proceeds to substep 148A, and distributes the entire backline back hand pot to the backline back hand player controlling the highest-ranked backline back hand. If there is a tie for the highest-ranked backline back hand, the dealer splits the backline back hand pot among the players controlling the tied hands according to steps 138A, 140A, 142A, and 144A identically as described above for steps 138, 140, 142, and 144 above in relation to FIG. 10.

The simplified method described above allows the game to proceed at a more rapid pace while still allowing for multiple winners on each game round and still allowing backline play.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A method of bet placement and wager distribution for use in conjunction with a game having a plurality of frontline players, a plurality of backline players, a round of play, and associated rules, where said frontline players each control a front hand and a back hand each of which, at the end of said round of play, may be ranked in comparison with other of said frontline players' front and back hands, respectively, comprising the steps of:

identifying said frontline players and said backline players for said round of play;

placing by each of said frontline players a frontline front hand wager amount into a frontline front hand wagering area and a frontline back hand wager amount into a frontline back hand wagering area, by which said frontline player wagers on said front and said back hands, all of said frontline front hand wagers summing to a frontline front hand pot and all of said frontline back hand wagers summing to a frontline back hand pot;

placing by each of said backline players either a backline front hand wager amount into a backline front hand wagering area or a backline back hand wager amount into a backline back hand wagering area, said wagering areas being positioned such that each said front hand wagering area corresponds to one of said front hands to be dealt and each said back hand wagering area corresponds to one of said back hands to be dealt, by which said backline player wagers on said front or said back hand, all of said backline front hand wagers summing to a backline front hand pot and all of said backline back hand wagers summing to a backline back hand pot;

distributing one of said front hands and one of said back hands to each of said frontline players;

playing said round of said game, said frontline players each controlling their respective said front and back hands in conformity with said associated rules of said game, each of said front hands having a comparative final ranking with respect to the other front hands and each of said back hands having a comparative final ranking with respect to the other back hands;

determining a frontline front hand comparative final ranking for each of said front hands in relation to said other front hands, said frontline front hand comparative final ranking identifying a highest-ranked frontline front hand or hands and a second-highest ranked frontline front hand or hands;

determining a frontline back hand comparative final ranking for each of said back hands in relation to said other back hands, said frontline back hand comparative final ranking identifying a highest-ranked frontline back hand or hands and a second-highest ranked frontline back hand or hands;

determining a backline front hand comparative final ranking for each of said front hands on which at least one of said backline players wagered in relation to other said front hands on which at least one of said backline players wagered, said backline front hand comparative final ranking identifying a highest-ranked backline front hand or hands and a second-highest ranked backline front hand or hands;

determining a backline back hand comparative final ranking for each of said back hands on which at least one of said backline players wagered in relation to other said back hands on which at least one of said backline players wagered, said backline back hand comparative final ranking identifying a highest-ranked backline back hand or hands and a second-highest ranked backline back hand or hands;

distributing said frontline front hand pot between the frontline player or players controlling said highest-ranked frontline front hand or hands and the frontline player or players controlling said second-highest ranked frontline front hand or hands, according to a frontline front hand predetermined formula;

distributing said frontline back hand pot between the frontline player or players controlling said highest-ranked frontline back hand or hands and the frontline player or players controlling said second-highest ranked frontline back hand or hands, according to a frontline back hand predetermined formula;

distributing said backline front hand pot between the backline player or players controlling said highest-ranked backline front hand or hands and the backline player or players controlling said second-highest ranked backline front hand or hands, according to a backline front hand predetermined formula; and distributing said backline back hand pot between the backline player or players controlling said highest-ranked backline back hand or hands and the backline player or players controlling said second-highest ranked backline back hand or hands, according to a backline back hand predetermined formula.

2. The method of claim 1 wherein said game constitutes a card game and said front and back hands of said frontline players constitute hands of cards dealt to said frontline players.

3. The method of claim 1 wherein each said frontline front hand wager amount equals a predetermined table limit, said frontline back hand wager amount equals a predetermined table limit, said backline front hand equals a predetermined table limit, and said backline back hand wager amount equals a predetermined table limit.

4. The method of claim 1 wherein a dealer controls play of said game, distributes said hands, and controls collection of wagers and distribution of said players' pots, and further comprising the steps of paying by each of said frontline players a predetermined collection amount to said dealer, and paying by each of said backline players a predetermined collection amount to said dealer.

5. The method of claim 1 wherein said step of identifying said frontline players and said backline players for said round of play is followed by the further steps of:

identifying a first-seated frontline player starting a sequential frontline order among said frontline players;

placing a first-seat frontline marker adjacent to said first-seated frontline player;

identifying a first-seated backline front hand player starting a sequential backline front order among said backline front hand players;

placing a first-seat backline front marker adjacent to the wagering area into which said first-seated backline front hand player placed his or her wager;

identifying a first-seated backline back hand player starting a sequential backline back order among said backline back hand players;

placing a first-seat backline back marker adjacent to the wagering area into which said first-seated backline back hand player placed his or her wager.

6. The method of claim 5 wherein said frontline players are seated in a circular configuration and wherein said sequential frontline order is determined by proceeding clockwise around said circular configuration of said frontline players from said first-seated frontline player; wherein said backline front hard players stand behind said frontline players forming a circular configuration and wherein said sequential backline front hand order is determined by proceeding clockwise around said circular configuration of said backline front hand players from said first-seated backline front hand player; and wherein said backline back hand players stand behind said frontline players forming a circular configuration and wherein said sequential backline back hand order is determined by proceeding clockwise around said circular configuration of said backline back hand players from said first-seated backline back hand player.

7. The method of claim 5 wherein said frontline players are seated in a circular configuration and wherein said sequential frontline order is determined by proceeding counterclockwise around said circular configuration of said frontline players from said first-seated frontline player; wherein said backline front hard players stand behind said frontline players forming a circular configuration and wherein said sequential backline front hand order is determined by proceeding counterclockwise around said circular configuration of said backline front hand players from said first-seated backline front hand player; and wherein said backline back hand players stand behind said frontline players forming a circular configuration and wherein said sequential backline back hand order is determined by proceeding counterclockwise around said circular configuration of said backline back hand players from said first-seated backline back hand player.

8. The method of claim 5 wherein said steps of selecting said first-seated frontline player, said first-seated backline front player, and said first-seated backline back player further comprise:

selecting, when a prior round of said game has been played and a prior first-seated frontline player was selected in said prior round, the frontline player following said prior first-seated frontline player in said sequential frontline order to be said first-seated frontline player;

selecting at random, when no prior first-seated frontline player has been selected, one of said frontline players to be said first-seated frontline player;

selecting, when said prior round of said game has been played and a prior first-seated backline front hand player was selected in said prior round, the backline front hand player following said prior first-seated backline front hand player in said sequential backline front order to be said first-seated backline front hand player;

selecting at random, when no prior first-seated backline front hand player has been selected, one of said backline front hand players to be said first-seated backline front hand player;

selecting, when said prior round of said game has been played and a prior first-seated backline back hand player was selected in said prior round, the backline back hand player following said prior first-seated backline back hand player in said sequential backline back order to be said first-seated backline back hand player;

selecting at random, when no prior first-seated backline back hand player has been selected, one of said backline back hand players to be said first-seated backline back hand player.

9. The method of claim 5 wherein said step of distributing one of said front hands and one of said back hands to each of said frontline players further comprises beginning with said first-seated frontline player and continuing in a predetermined sequential frontline order among said frontline players.

10. The method of claim 5 wherein said step of distributing said frontline front hand pot between the frontline players further comprises:

dividing, when there is more than one highest-ranked frontline front hand, the frontline front hand pot into one equal portion for each highest-ranked frontline front hand and distributing one such portion to each frontline player controlling one of the highest-ranked frontline front hands, such that if the division creates one or more odd chips which cannot be divided equally into said equal portions, said odd chips are distributed one to each player controlling a highest-ranked frontline front hand starting with the first such player to follow said first-seated frontline player in said sequential frontline order and continuing to succeeding such players according to said sequential frontline order until all of said odd chips have been distributed;

distributing, when there is only one highest-ranked frontline front hand and there are less than four frontline players, said frontline front hand pot to the frontline player controlling said highest-ranked frontline front hand;

dividing, when there is only one highest-ranked frontline front hand and there are four or more frontline players, said frontline front hand pot into three parts, distributing two of said parts to the frontline player controlling said highest-ranked frontline front hand, and retaining one of said parts as a remainder to be distributed to the frontline player or players controlling said second-highest ranked frontline front hands, such that if the division creates one or more odd chips which cannot be divided equally into said three parts, one odd chip is distributed to said frontline player controlling said highest-ranked frontline front hand and any other odd chip is added to said remainder;

dividing, when said remainder is retained and there is more than one second-highest ranked frontline front hand, said remainder into one equal portion for each frontline player controlling one of said second-highest ranked frontline front hands and distributing one such portion to each such player, such that if the division creates one or more odd chips which cannot be divided equally into said equal portions, said odd chips are distributed one to each frontline player controlling one of said second-highest ranked frontline front hands starting with the first such player to follow said first-seated frontline player in said sequential frontline order and continuing to succeeding such players according to said sequential frontline order until all of said odd chips have been distributed; and distributing, when said remainder is retained and there is only one second-highest ranked frontline front hand, said remainder to the frontline front hand player controlling said second-highest ranked frontline front hand.

11. The method of claim 5 wherein said step of distributing said frontline back hand pot between the frontline players further comprises:

dividing, when there is more than one highest-ranked frontline back hand, the frontline back hand pot into one equal portion for each highest-ranked frontline back hand and distributing one such portion to each frontline player controlling one of the highest-ranked frontline back hands, such that if the division creates one or more odd chips which cannot be divided equally into said equal portions, said odd chips are distributed one to each player controlling a highest-ranked frontline back hand starting with the first such player to follow said first-seated frontline player in said sequential frontline order and continuing to succeeding such players according to said sequential frontline order until all of said odd chips have been distributed;

distributing, when there is only one highest-ranked frontline back hand and there are less than four frontline players, said frontline back hand pot to the frontline player controlling said highest-ranked frontline back hand;

dividing, when there is only one highest-ranked frontline back hand and there are four or more frontline players, said frontline back hand pot into three parts, distributing two of said parts to the frontline player controlling said highest-ranked frontline back hand, and retaining one of said parts as a remainder to be distributed to the frontline player or players controlling said second-highest ranked frontline back hands, such that if the division creates one or more odd chips which cannot be divided equally into said three parts, one odd chip is distributed to said frontline player controlling said highest-ranked frontline back hand and any other odd chip is added to said remainder;

dividing, when said remainder is retained and there is more than one second-highest ranked frontline back hand, said remainder into one equal portion for each frontline player controlling one of said second-highest ranked frontline back hands and distributing one such portion to each such player, such that if the division creates one or more odd chips which cannot be divided equally into said equal portions, said odd chips are distributed one to each frontline player controlling one of said second-highest ranked frontline back hands starting with the first such player to follow said first-seated frontline player in said sequential frontline order and continuing to succeeding such players according to said sequential frontline order until all of said odd chips have been distributed; and distributing, when said remainder is retained and there is only one second-highest ranked frontline back hand, said remainder to the frontline back hand player controlling said second-highest ranked frontline back hand.

12. The method of claim 5 wherein said step of distributing said backline front hand pot between the backline front hand players further comprises:

dividing, when there is more than one highest-ranked backline front hand, the backline front hand pot into one equal portion for each highest-ranked backline front hand and distributing one such portion to each backline front hand player controlling one of the highest-ranked backline front hands, such that if the division creates one or more odd chips which cannot be divided equally into said equal portions, said odd chips are distributed one to each player controlling a highest-ranked backline front hand starting with the first such player to follow said first-seated backline front hand player in said sequential backline front order and continuing to succeeding such players according to said sequential backline front order until all of said odd chips have been distributed;

distributing, when there is only one highest-ranked backline front hand and there are less than four backline front hand players, said backline front hand pot to the backline front hand player controlling said highest-ranked backline front hand;

dividing, when there is only one highest-ranked backline front hand and there are four or more backline front hand players, said backline front hand pot into three parts, distributing two of said parts to the backline front hand player controlling said highest-ranked backline front hand, and retaining one of said parts as a remainder to be distributed to the backline front hand player or players controlling said second-highest ranked backline front hands, such that if the division creates one or more odd chips which cannot be divided equally into said three parts, one odd chip is distributed to said backline front hand player controlling said highest-ranked backline front hand and any other odd chip is added to said remainder;

dividing, when said remainder is retained and there is more than one second-highest ranked backline front hand, said remainder into one equal portion for each backline front hand player controlling one of said second-highest ranked backline front hands and distributing one such portion to each such player, such that if the division creates one or more odd chips which cannot be divided equally into said equal portions, said odd chips are distributed one to each backline front hand player controlling one of said second-highest ranked backline front hands starting with the first such player to follow said first-seated backline front hand player in said sequential backline front order and continuing to succeeding such players according to said sequential backline front order until all of said odd chips have been distributed; and distributing, when said remainder is retained and there is only one second-highest ranked backline front hand, said remainder to the backline front hand player controlling said second-highest ranked backline front hand.

13. The method of claim 5 wherein said step of distributing said backline back hand pot between the backline back hand players further comprises:

dividing, when there is more than one highest-ranked backline back hand, the backline back hand pot into one equal portion for each highest-ranked backline back hand and distributing one such portion to each backline back hand player controlling one of the highest-ranked backline back hands, such that if the division creates one or more odd chips which cannot be divided equally into said equal portions, said odd chips are distributed one to each player controlling a highest-ranked backline back hand starting with the first such player to follow said first-seated backline back hand player in said sequential backline back order and continuing to succeeding such players according to said sequential backline back order until all of said odd chips have been distributed;

distributing, when there is only one highest-ranked backline back hand and there are less than four backline back hand players, said backline back hand pot to the backline back hand player controlling said highest-ranked backline back hand;

dividing, when there is only one highest-ranked backline back hand and there are four or more backline back hand players, said backline back hand pot into three parts, distributing two of said parts to the backline back hand player controlling said highest-ranked backline back hand, and retaining one of said parts as a remainder to be distributed to the backline back hand player or players controlling said second-highest ranked backline back hands, such that if the division creates one or more odd chips which cannot be divided equally into said three parts, one odd chip is distributed to said backline back hand player controlling said highest-ranked backline back hand and any other odd chip is added to said remainder;

dividing, when said remainder is retained and there is more than one second-highest ranked backline back hand, said remainder into one equal portion for each backline back hand player controlling one of said second-highest ranked backline back hands and distributing one such portion to each such player, such that if the division creates one or more odd chips which cannot be divided equally into said equal portions, said odd chips are distributed one to each backline back hand player controlling one of said second-highest ranked backline back hands starting with the first such player to follow said first-seated backline back hand player in said sequential backline back order and continuing to succeeding such players according to said sequential backline back order until all of said odd chips have been distributed; and distributing, when said remainder is retained and there is only one second-highest ranked backline back hand, said remainder to the backline back hand player controlling said second-highest ranked backline back hand.

14. A method of bet placement and wager distribution for use in conjunction with a round of play of Double Hand Poker having a plurality of frontline players, a plurality of backline players, and associated rules, where said frontline players each control a front hand of two cards and a back hand of five cards each of which, at the end of said round of play, may be ranked in comparison with other of said frontline players' front and back hands, respectively, comprising the steps of:

identifying said frontline players and said backline players for said round of play;

placing by each of said frontline players a frontline front hand wager amount into a frontline front hand wagering area and a frontline back hand wager amount into a frontline back hand wagering area, by which said frontline player wagers on said front and said back hands, all of said frontline front hand wagers summing to a frontline front hand pot and all of said frontline back hand wagers summing to a frontline back hand pot;

placing by each of said backline players either a backline front hand wager amount into a backline front hand wagering area or a backline back hand wager amount into a backline back hand wagering area, said wagering areas being positioned such that each said front hand wagering area corresponds to one of said front hands to be dealt and each said back hand wagering area corresponds to one of said back hands to be dealt, by which said backline player wagers on said front or said back hand, all of said backline front hand wagers summing to a backline front hand pot and all of said backline back hand wagers summing to a backline back hand pot;

distributing a hand of seven cards to each of said frontline players, said frontline players forming said front hand of two cards and said back hand of five cards from said hand of seven cards;

playing said round of Double Hand Poker, said frontline players each controlling their respective said front and back hands in conformity with said associated rules, each of said front hands having a comparative final ranking with respect to the other front hands and each of said back hands having a comparative final ranking with respect to the other back hands;

determining a frontline front hand comparative final ranking for each of said front hands in relation to said other front hands, said frontline front hand comparative final ranking identifying a highest-ranked frontline front hand or hands;

determining a frontline back hand comparative final ranking for each of said back hands in relation to said other back hands, said frontline back hand comparative final ranking identifying a highest-ranked frontline back hand or hands;

determining a backline front hand comparative final ranking for each of said front hands on which at least one of said backline players wagered in relation to other said front hands on which at least one of said backline players wagered, said backline front hand comparative final ranking identifying a highest-ranked backline front hand or hands;

determining a backline back hand comparative final ranking for each of said back hands on which at least one of said backline players wagered in relation to other said back hands on which at least one of said backline players wagered, said backline back hand comparative final ranking identifying a highest-ranked backline back hand or hands;

distributing, when there is only one highest-ranked frontline front hand, said frontline front hand pot to the frontline player controlling said highest-ranked frontline front hand;

dividing, when there is more than one highest-ranked frontline front hand, the frontline front hand pot into one equal portion for each highest-ranked frontline front hand and distributing one such portion to each frontline player controlling one of the highest-ranked frontline front hands, such that if the division creates one or more odd chips which cannot be divided equally into said equal portions, said odd chips are distributed one to each player controlling a highest-ranked frontline front hand starting with the first such player to follow said first-seated frontline player in said sequential frontline order and continuing to succeeding such players according to said sequential frontline order until all of said odd chips hare been distributed;

distributing, when there is only one highest-ranked frontline back hand, said frontline back hand pot to the frontline player controlling said highest-ranked frontline back hand;

dividing, when there is more than one highest-ranked frontline back hand, the frontline back hand pot into one equal portion for each highest-ranked frontline back hand and distributing one such portion to each frontline player controlling one of the highest-ranked frontline back hands, such that if the division creates one or more odd chips which cannot be divided equally into said equal portions, said odd chips are distributed one to each player controlling a highest-ranked frontline back hand starting with the first such player to follow said first-seated frontline player in said sequential frontline order and continuing to succeeding such players according to said sequential frontline order until all of said odd chips have been distributed;

distributing, when there is only one highest-ranked backline front hand, said backline front hand pot to the backline front hand player controlling said highest-ranked backline front hand;

dividing, when there is more than one highest-ranked backline front hand, the backline front hand pot into one equal portion for each highest-ranked backline front hand and distributing one such portion to each backline front hand player controlling one of the highest-ranked backline front hands, such that if the division creates one or more odd chips which cannot be divided equally into said equal portions, said odd chips are distributed one to each player controlling a highest-ranked backline front hand starting with the first such player to follow said first-seated backline front hand player in said sequential backline front order and continuing to succeeding such players according to said sequential backline front order until all of said odd chips have been distributed;

distributing, when there is only one highest-ranked backline back hand, said backline back hand pot to the backline player controlling said highest-ranked backline back hand;

dividing, when there is more than one highest-ranked backline back hand, the backline back hand pot into one equal portion for each highest-ranked backline back hand and distributing one such portion to each backline back hand player controlling one of the highest-ranked backline back hands, such that if the division creates one or more odd chips which cannot be divided equally into said equal portions, said odd chips are distributed one to each player controlling a highest-ranked backline back hand starting with the first such player to follow said first-seated backline back hand player in said sequential backline back order and continuing to succeeding such players according to said sequential backline back order until all of said odd chips have been distributed.

15. A method of bet placement and wager distribution for use in conjunction with a game having a plurality of frontline players, a round of play, and associated rules, where said frontline players each control a front hand and a back hand each of which, at the end of said round of play, may be ranked in comparison with other of said frontline players' front and back hands, respectively, comprising the steps of:

identifying said frontline players for said round of play;

placing by each of said frontline players a frontline front hand wager amount into a frontline front hand wagering area and a frontline back hand wager amount into a frontline back hand wagering area, by which said frontline player wagers on said front and said back hands, all of said frontline front hand wagers summing to a frontline front hand pot and all of said frontline back hand wagers summing to a frontline back hand pot;

distributing one of said front hands and one of said back hands to each of said frontline players;

playing said round of said game, said frontline players each controlling their respective said front and back hands in conformity with said associated rules of said game, each of said front hands having a comparative final ranking with respect to the other front hands;

determining a frontline front hand comparative final ranking for each of said front hands in relation to said other front hands, said frontline front hand comparative final ranking identifying a highest-ranked frontline front hand or hands and a second-highest ranked frontline front hand or hands;

determining a frontline back hand comparative final ranking for each of said back hands in relation to said other back hands, said frontline back hand comparative final ranking identifying a highest-ranked frontline back hand or hands and a second-highest ranked frontline back hand or hands;

dividing, when there is more than one highest-ranked frontline front hand, the frontline front hand pot into one equal portion for each highest-ranked frontline front hand and distributing one such portion to each frontline player controlling one of the highest-ranked frontline front hands, such that if the division creates one or more odd chips which cannot be divided equally into said equal portions, said odd chips are distributed one to each player controlling a highest-ranked frontline front hand starting with the first such player to follow said first-seated frontline player in said sequential frontline order and continuing to succeeding such players according to said sequential frontline order until all of said odd chips have been distributed;

distributing, when there is only one highest-ranked frontline front hand and there are less than four frontline players, said frontline front hand pot to the frontline player controlling said highest-ranked frontline front hand;

dividing, when there is only one highest-ranked frontline front hand and there are four or more frontline players, said frontline front hand pot into three parts, distributing two of said parts to the frontline player controlling said highest-ranked frontline front hand, and retaining one of said parts as a remainder to be distributed to the frontline player or players controlling said second-highest ranked frontline front hands, such that if the division creates one or more odd chips which cannot be divided equally into said three parts, one odd chip is distributed to said frontline player controlling said highest-ranked frontline front hand and any other odd chip is added to said remainder;

dividing, when said remainder is retained and there is more than one second-highest ranked frontline front hand, said remainder into one equal portion for each frontline player controlling one of said second-highest ranked frontline front hands and distributing one such portion to each such player, such that if the division creates one or more odd chips which cannot be divided equally into said equal portions, said odd chips are distributed one to each frontline player controlling one of said second-highest ranked frontline front hands starting with the first such player to follow said first-seated frontline player in said sequential frontline order and continuing to succeeding such players according to said sequential frontline order until all of said odd chips have been distributed;

distributing, when said remainder is retained and there is only one second-highest ranked frontline front hand, said remainder to the frontline front hand player controlling said second-highest ranked frontline front hand;

dividing, when there is more than one highest-ranked frontline back hand, the frontline back hand pot into one equal portion for each highest-ranked frontline back hand and distributing one such portion to each frontline player controlling one of the highest-ranked frontline back hands, such that if the division creates one or more odd chips which cannot be divided equally into said equal portions, said odd chips are distributed one to each player controlling a highest-ranked frontline back hand starting with the first such player to follow said first-seated frontline player in said sequential frontline order and continuing to succeeding such players according to said sequential frontline order until all of said odd chips have been distributed;

distributing, when there is only one highest-ranked frontline back hand and there are less than four frontline players, said frontline back hand pot to the frontline player controlling said highest-ranked frontline back hand;

dividing, when there is only one highest-ranked frontline back hand and there are four or more frontline players, said frontline back hand pot into three parts, distributing two of said parts to the frontline player controlling said highest-ranked frontline back hand, and retaining one of said parts as a remainder to be distributed to the frontline player or players controlling said second-highest ranked frontline back hands, such that if the division creates one or more odd chips which cannot be divided equally into said three parts, one odd chip is distributed to said frontline player controlling said highest-ranked frontline back hand and any other odd chip is added to said remainder;

dividing, when said remainder is retained and there is more than one second-highest ranked frontline back hand, said remainder into one equal portion for each frontline player controlling one of said second-highest ranked frontline back hands and distributing one such portion to each such player, such that if the division creates one or more odd chips which cannot be divided equally into said equal portions, said odd chips are distributed one to each frontline player controlling one of said second-highest ranked frontline back hands starting with the first such player to follow said first-seated frontline player in said sequential frontline order and continuing to succeeding such players according to said sequential frontline order until all of said odd chips have been distributed; and distributing, when said remainder is retained and there is only one second-highest ranked frontline back hand, said remainder to the frontline back hand player controlling said second-highest ranked frontline back hand.

16. The method of claim 15 wherein said game constitutes a card game and said front and back hands of said frontline players constitute hands of cards dealt to said frontline players.

17. The method of claim 15 wherein each said frontline front hand wager amount equals a predetermined table limit and said frontline back hand wager amount equals a predetermined table limit.

18. The method of claim 15 wherein a dealer controls play of said game, distributes said hands, and controls collection of wagers and distribution of said players' pots, and further comprising the step of paying by each of said frontline players a predetermined collection amount to said dealer.

19. The method of claim 15 wherein said step of identifying said frontline players for said round of play is followed by the further steps of:

identifying a first-seated frontline player starting a sequential frontline order among said frontline players; and placing a first-seat frontline marker adjacent to said first-seated frontline player.

20. The method of claim 19 wherein said frontline players are seated in a circular configuration and wherein said sequential frontline order is determined by proceeding clockwise around said circular configuration of said frontline players from said first-seated frontline player.

21. The method of claim 19 wherein said frontline players are seated in a circular configuration and wherein said sequential frontline order is determined by proceeding counterclockwise around said circular configuration of said frontline players from said first-seated frontline player.

22. The method of claim 19 wherein said step of selecting said first-seated frontline player further comprises:

selecting, when a prior round of said game has been played and a prior first-seated frontline player was selected in said prior round, the frontline player following said prior first-seated frontline player in said sequential frontline order to be said first-seated frontline player; and selecting at random, when no prior first-seated frontline player has been selected, one of said frontline players to be said first-seated frontline player.

23. The method of claim 19 wherein said step of distributing one of said front hands and one of said back hands to each of said frontline players further comprises beginning with said first-seated frontline player and continuing in a predetermined sequential frontline order among said frontline players.

24. A method of bet placement and wager distribution for use in conjunction with a game having a plurality of frontline players, a plurality of backline players, a round of play, and associated rules, where said frontline players each control a front hand and a back hand each of which, at the end of said round of play, may be ranked in comparison with other of said frontline players' front and back hands, respectively, comprising the steps of:

identifying said frontline players and said backline players for said round of play;

placing by each of said frontline players a frontline front hand wager amount into a frontline front hand wagering area and a frontline back hand wager amount into a frontline back hand wagering area, by which said frontline player wagers on said front and said back hands, all of said frontline front hand wagers summing to a frontline front hand pot and all of said frontline back hand wagers summing to a frontline back hand pot;

placing by each of said backline players either a backline front hand wager amount into a backline front hand wagering area or a backline back hand wager amount into a backline back hand wagering area, said wagering areas being positioned such that each said front hand wagering area corresponds to one of said front hands to be dealt and each said back hand wagering area corresponds to one of said back hands to be dealt, by which said backline player wagers on said front or said back hand, all of said backline front hand wagers summing to a backline front hand pot and all of said backline back hand wagers summing to a backline back hand pot;

distributing one of said front hands and one of said back hands to each of said frontline players;

playing said round of said game, said frontline players each controlling their respective said front and back hands in conformity with said associated rules of said game, each of said front hands having a comparative final ranking with respect to the other front hands and each of said back hands having a comparative final ranking with respect to the other back hands;

determining a frontline front hand comparative final ranking for each of said front hands in relation to said other front hands, said frontline front hand comparative final ranking identifying a highest-ranked frontline front hand or hands and a second-highest ranked frontline front hand or hands;

determining a frontline back hand comparative final ranking for each of said back hands in relation to said other back hands, said frontline back hand comparative final ranking identifying a highest-ranked frontline back hand or hands and a second-highest ranked frontline back hand or hands;

determining a backline front hand comparative final ranking for each of said front hands on which at least one of said backline players wagered in relation to other said front hands on which at least one of said backline players wagered, said backline front hand comparative final ranking identifying a highest-ranked backline front hand or hands and a second-highest ranked backline front hand or hands;

determining a backline back hand comparative final ranking for each of said back hands on which at least one of said backline players wagered in relation to other said back hands on which at least one of said backline players wagered, said backline back hand comparative final ranking identifying a highest-ranked backline back hand or hands and a second-highest ranked backline back hand or hands;

dividing, when there is more than one highest-ranked frontline front hand, the frontline front hand pot into one equal portion for each highest-ranked frontline front hand and distributing one such portion to each frontline player controlling one of the highest-ranked frontline front hands, such that if the division creates one or more odd chips which cannot be divided equally into said equal portions, said odd chips are distributed one to each player controlling a highest-ranked frontline front hand starting with the first such player to follow said first-seated frontline player in said sequential frontline order and continuing to succeeding such players according to said sequential frontline order until all of said odd chips have been distributed;

distributing, when there is only one highest-ranked frontline front hand and there are less than four frontline players, said frontline front hand pot to the frontline player controlling said highest-ranked frontline front hand;

dividing, when there is only one highest-ranked frontline front hand and there are four or more frontline players, said frontline front hand pot into three parts, distributing two of said parts to the frontline player controlling said highest-ranked frontline front hand, and retaining one of said parts as a remainder to be distributed to the frontline player or players controlling said second-highest ranked frontline front hands, such that if the division creates one or more odd chips which cannot be divided equally into said three parts, one odd chip is distributed to said frontline player controlling said highest-ranked frontline front hand and any other odd chip is added to said remainder;

dividing, when said remainder is retained and there is more than one second-highest ranked frontline front hand, said remainder into one equal portion for each frontline player controlling one of said second-highest ranked frontline front hands and distributing one such portion to each such player, such that if the division creates one or more odd chips which cannot be divided equally into said equal portions, said odd chips are distributed one to each frontline player controlling one of said second-highest ranked frontline front hands starting with the first such player to follow said first-seated frontline player in said sequential frontline order and continuing to succeeding such players according to said sequential frontline order until all of said odd chips have been distributed;

distributing, when said remainder is retained and there is only one second-highest ranked frontline front hand, said remainder to the frontline front hand player controlling said second-highest ranked frontline front hand;

dividing, when there is more than one highest-ranked frontline back hand, the frontline back hand pot into one equal portion for each highest-ranked frontline back hand and distributing one such portion to each frontline player controlling one of the highest-ranked frontline back hands, such that if the division creates one or more odd chips which cannot be divided equally into said equal portions, said odd chips are distributed one to each player controlling a highest-ranked frontline back hand starting with the first such player to follow said first-seated frontline player in said sequential frontline order and continuing to succeeding such players according to said sequential frontline order until all of said odd chips have been distributed;

distributing, when there is only one highest-ranked frontline back hand and there are less than four frontline players, said frontline back hand pot to the frontline player controlling said highest-ranked frontline back hand;

dividing, when there is only one highest-ranked frontline back hand and there are four or more frontline players, said frontline back hand pot into three parts, distributing two of said parts to the frontline player controlling said highest-ranked frontline back hand, and retaining one of said parts as a remainder to be distributed to the frontline player or players controlling said second-highest ranked frontline back hands, such that if the division creates one or more odd chips which cannot be divided equally into said three parts, one odd chip is distributed to said frontline player controlling said highest-ranked frontline back hand and any other odd chip is added to said remainder;

dividing, when said remainder is retained and there is more than one second-highest ranked frontline back hand, said remainder into one equal portion for each frontline player controlling one of said second-highest ranked frontline back hands and distributing one such portion to each such player, such that if the division creates one or more odd chips which cannot be divided equally into said equal portions, said odd chips are distributed one to each frontline player controlling one of said second-highest ranked frontline back hands starting with the first such player to follow said first-seated frontline player in said sequential frontline order and continuing to succeeding such players according to said sequential frontline order until all of said odd chips have been distributed;

distributing, when said remainder is retained and there is only one second-highest ranked frontline back hand, said remainder to the frontline back hand player controlling said second-highest ranked frontline back hand;

dividing, when there is more than one highest-ranked backline front hand, the backline front hand pot into one equal portion for each highest-ranked backline front hand and distributing one such portion to each backline front hand player controlling one of the highest-ranked backline front hands, such that if the division creates one or more odd chips which cannot be divided equally into said equal portions, said odd chips are distributed one to each player controlling a highest-ranked backline front hand starting with the first such player to follow said first-seated backline front hand player in said sequential backline front order and continuing to succeeding such players according to said sequential backline front order until all of said odd chips have been distributed;

distributing, when there is only one highest-ranked backline front hand and there are less than four backline front hand players, said backline front hand pot to the backline front hand player controlling said highest-ranked backline front hand;

dividing, when there is only one highest-ranked backline front hand and there are four or more backline front hand players, said backline front hand pot into three parts, distributing two of said parts to the backline front hand player controlling said highest-ranked backline front hand, and retaining one of said parts as a remainder to be distributed to the backline front hand player or players controlling said second-highest ranked backline front hands, such that if the division creates one or more odd chips which cannot be divided equally into said three parts, one odd chip is distributed to said backline front hand player controlling said highest-ranked backline front hand and any other odd chip is added to said remainder;

dividing, when said remainder is retained and there is more than one second-highest ranked backline front hand, said remainder into one equal portion for each backline front hand player controlling one of said second-highest ranked backline front hands and distributing one such portion to each such player, such that if the division creates one or more odd chips which cannot be divided equally into said equal portions, said odd chips are distributed one to each backline front hand player controlling one of said second-highest ranked backline front hands starting with the first such player to follow said first-seated backline front hand player in said sequential backline front order and continuing to succeeding such players according to said sequential backline front order until all of said odd chips have been distributed;

distributing, when said remainder is retained and there is only one second-highest ranked backline front hand, said remainder to the backline front hand player controlling said second-highest ranked backline front hand;

dividing, when there is more than one highest-ranked backline back hand, the backline back hand pot into one equal portion for each highest-ranked backline back hand and distributing one such portion to each backline back hand player controlling one of the highest-ranked backline back hands, such that if the division creates one or more odd chips which cannot be divided equally into said equal portions, said odd chips are distributed one to each player controlling a highest-ranked backline back hand starting with the first such player to follow said first-seated backline back hand player in said sequential backline back order and continuing to succeeding such players according to said sequential backline back order until all of said odd chips have been distributed;

distributing, when there is only one highest-ranked backline back hand and there are less than four backline back hand players, said backline back hand pot to the backline back hand player controlling said highest-ranked backline back hand;

dividing, when there is only one highest-ranked backline back hand and there are four or more backline back hand players, said backline back hand pot into three parts, distributing two of said parts to the backline back hand player controlling said highest-ranked backline back hand, and retaining one of said parts as a remainder to be distributed to the backline back hand player or players controlling said second-highest ranked backline back hands, such that if the division creates one or more odd chips which cannot be divided equally into said three parts, one odd chip is distributed to said backline back hand player controlling said highest-ranked backline back hand and any other odd chip is added to said remainder;

dividing, when said remainder is retained and there is more than one second-highest ranked backline back hand, said remainder into one equal portion for each backline back hand player controlling one of said second-highest ranked backline back hands and distributing one such portion to each such player, such that if the division creates one or more odd chips which cannot be divided equally into said equal portions, said odd chips are distributed one to each backline back hand player controlling one of said second-highest ranked backline back hands starting with the first such player to follow said first-seated backline back hand player in said sequential backline back order and continuing to succeeding such players according to said sequential backline back order until all of said odd chips have been distributed; and distributing, when said remainder is retained and there is only one second-highest ranked backline back hand, said remainder to the backline back hand player controlling said second-highest ranked backline back hand.

* * * * *